US010335925B2

(12) United States Patent
Layton, Jr. et al.

(10) Patent No.: US 10,335,925 B2
(45) Date of Patent: Jul. 2, 2019

(54) SKATE BLADE HOLDER TOOL

(71) Applicant: Velasa Sports, Inc., Acton, MA (US)

(72) Inventors: Russell K. Layton, Jr., Acton, MA (US); Daniel A. Beaudet, Lexington, MA (US); Ivan D. Goryachev, Nashua, NH (US)

(73) Assignee: VELASA SPORTS, INC., Acton, MA (US)

( * ) Notice: Subject to any disclaimer, the term of this patent is extended or adjusted under 35 U.S.C. 154(b) by 0 days.

(21) Appl. No.: 15/448,426

(22) Filed: Mar. 2, 2017

(65) Prior Publication Data

US 2017/0252901 A1 Sep. 7, 2017

Related U.S. Application Data

(60) Provisional application No. 62/303,325, filed on Mar. 3, 2016.

(51) Int. Cl.

| | |
|---|---|
| ***B24B 3/00*** | (2006.01) |
| ***B24B 9/04*** | (2006.01) |
| ***B24B 41/06*** | (2012.01) |
| ***B24D 15/06*** | (2006.01) |
| ***A63C 3/10*** | (2006.01) |
| ***A63C 1/30*** | (2006.01) |

(52) U.S. Cl.

CPC ..... *B24D 15/066* (2013.01); *A63C 1/303* (2013.01); *A63C 3/10* (2013.01); *B24B 3/00* (2013.01); *B24B 3/003* (2013.01); *B24B 9/04* (2013.01); *B24B 41/06* (2013.01)

(58) Field of Classification Search

CPC .. B24B 3/00; B24B 3/003; B24B 9/04; B24B 41/06; A63C 1/12; A63C 1/32; A63C 1/303; A63C 3/10

USPC ..... 451/344, 349, 383, 365, 386

See application file for complete search history.

(56) References Cited

U.S. PATENT DOCUMENTS

| | | | | |
|---|---|---|---|---|
| 3,015,492 | A * | 1/1962 | Kesner | A63C 3/12 280/825 |
| 3,839,828 | A | 10/1974 | Arnold | |
| 3,909,718 | A * | 9/1975 | Allsop | A63C 3/00 211/37 |
| 4,055,026 | A | 10/1977 | Zwicker | |
| 4,078,337 | A | 3/1978 | Chiasson et al. | |
| 4,271,635 | A | 6/1981 | Szalay | |
| 4,392,674 | A * | 7/1983 | Evon | A63C 3/12 280/825 |
| 4,722,152 | A | 2/1988 | Ek et al. | |
| 5,009,039 | A | 4/1991 | Lager et al. | |

(Continued)

OTHER PUBLICATIONS

Photograph of Free Runner Jig, from Twitter, Apr. 2014.

*Primary Examiner* — Eileen P Morgan

(74) *Attorney, Agent, or Firm* — Knobbe, Martens, Olson & Bear, LLP

(57) ABSTRACT

A blade holder tool is disclosed for a user to hold a skate blade and insert the skate blade into a sharpener unit for a sharpening operation. The blade holder tool includes an upper portion graspable by a user to hold the blade holder tool and place the blade holder tool in an inserted position in the sharpener unit. It further includes a lower blade-engaging portion that grasps the skate blade and locates the skate blade in a sharpening position in the sharpener unit.

19 Claims, 26 Drawing Sheets

(56) References Cited

U.S. PATENT DOCUMENTS 5,123,664 A * 6/1992 DeMars ..... A63C 1/14 280/11.18
5,513,881 A * 5/1996 DiMeglio ..... A63C 3/12 280/825
5,547,416 A 8/1996 Timms
D375,837 S * 11/1996 Frank ..... D3/317
6,422,934 B1 7/2002 Blach et al.
6,623,017 B1 * 9/2003 Steinhauser, Jr. ..... A63C 1/00 280/11.12
7,758,053 B2 * 7/2010 Wylie ..... A63C 1/32 280/11.12
8,038,157 B2 * 10/2011 Wylie ..... A63C 1/32 280/11.16
8,235,399 B2 * 8/2012 Tatomir ..... A63C 1/303 280/11.12
8,353,535 B2 * 1/2013 Salmon ..... A63C 1/28 280/600
8,454,030 B2 * 6/2013 Corbeil ..... A63C 1/303 280/10
8,550,472 B2 * 10/2013 Salmon ..... A63C 1/303 280/11.12
8,646,809 B2 * 2/2014 Lee ..... A63C 3/12 280/7.13
9,114,498 B1 8/2015 Layton, Jr. et al.
2002/0175481 A1 * 11/2002 Steinhauser, Jr. ..... A63C 1/00 280/11.18
2005/0130571 A1 6/2005 Sunnen
2006/0159533 A1 7/2006 Zeiler et al.
2006/0223419 A1 10/2006 Moon
2008/0001369 A1 * 1/2008 Wylie ..... A63C 1/32 280/11.12
2008/0280548 A1 11/2008 Wilson et al.
2010/0109312 A1 * 5/2010 Salmon ..... A63C 1/28 280/841
2010/0242308 A1 * 9/2010 Belles ..... A43B 3/0026 36/132
2011/0121527 A1 * 5/2011 Salmon ..... A63C 1/303 280/11.12
2011/0169232 A1 * 7/2011 Tatomir ..... A63C 1/303 280/11.18
2011/0169233 A1 7/2011 Wilson et al.
2012/0108151 A1 5/2012 Swist
2013/0093150 A1 * 4/2013 Dahlo ..... A63C 1/303 280/11.18
2013/0344774 A1 12/2013 Allen
2014/0179201 A1 6/2014 Proulx
2016/0096252 A1 4/2016 Layton, Jr. et al.

* cited by examiner

SKATE BLADE HOLDER TOOL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

The present invention is related to the field of skate blade sharpening systems for sharpening the blades of ice skates.

A variety of sharpening systems are known for sharpening skate blades. Historically, sharpening has been done on "complete" skates, i.e., skates with blades that are permanently or semi-permanently attached. For example, the blade may be secured to a blade holder portion (typically molded plastic) which is mounted to an upper skate boot. Sharpening systems have been designed accordingly. In particular, the systems have been designed with an assumption that a user can grasp and manipulate a skate boot and/or blade holder portion as needed to bring the skate blade into a position to be clamped and retained during sharpening.

More recently there is increasing use of skates with user-removable skate blades, enabling a skater to easily swap blades as might be desired for good performance. The removable blades, also referred to as "loose" blades herein, are long and narrow, measuring perhaps one inch in height when the blade is oriented horizontally as it is in use. The increasing use of such removable blades presents new challenges with respect to blade sharpening. First is a functional challenge—the need to sharpen a loose blade rather than a blade attached to a skate. More generally, players at all levels, including those who might not own multiple pairs of skates, may prefer to own several pairs of blades and swap them as often as they need to. This increases demand for sharpening, including at sub-professional levels where players are becoming more accustomed to always having sharp edges when playing. Thus, a second challenge has an economic component—to provide quality sharpening at lower cost to make it more accessible to a larger number of players. Cost requirements of course translate to technical requirements in the sense of favoring technical solutions that are relatively simple, accessible, and of low cost to manufacture and maintain.

SUMMARY

The present invention is motivated by the above and other challenges of sharpening loose skate blades, as described more herein. Additional aspects of the challenges are first elaborated, and then certain important features that address these challenges are described.

One challenge of sharpening a loose skate blade is that a user may not be able to easily, safely, and/or accurately load a loose skate blade into a skate sharpener for sharpening. Difficulty arises in part due to the short height of the blade and the relative lack of area for a user to grasp the blade when loading it into the clamp of a sharpening system. For example, a user may pinch or otherwise injure his/her fingers when securing a loose skate blade to a blade clamp. These challenges may be greater when using an automated, vertical mount configuration skate sharpener, an example of which is described herein. In these machines, the jaws that clamp the skate blade can be recessed below an upper slotted surface through which the blade passes during insertion and removal. The surface around the slot creates interference with the user's fingers when lowering the blade into the clamp. In some of these machines there also may not be any structure acting as a vertical stop for the blade during insertion. This lack of vertical stop increases the complexity of loading a loose blade. For example, a loose blade might easily be dropped into the enclosure of the skate sharpener, which might require that the sharpener be disassembled to retrieve the loose skate blade.

Other challenges relate to quality of sharpening as affected by inaccurate positioning of the skate blade. It is important that the skate blade be positioned and oriented correctly for best sharpening. Details of these issues are described further below. Existing solutions are seen to be either limited or even wholly inadequate at addressing this need for accurate positioning and orienting of the skate blade. Additionally, it is important that a new solution involve one tool with a universal quality so as to work with skate blades of various sizes.

A blade holder tool is disclosed for a user to hold a skate blade and insert the skate blade into a sharpener unit for a sharpening operation. The skate blade is a user-removable skate blade having a central portion and endward portions that include blade retention features that engage a user-controlled blade retention mechanism of a skate to secure the skate blade in the skate. The retention features of the skate blade having a blade-size-specific spacing in a spacing range for skate blades across a range of blade sizes.

The blade holder tool includes an upper portion graspable by a user to hold the blade holder tool and place the blade holder tool in an inserted position in the sharpener unit. It further includes a lower blade-engaging portion that grasps the central portion of the skate blade and locates the skate blade in a sharpening position in the sharpener unit when the blade holder tool is in the inserted position holding the skate blade. Because it grasps skate blade in a central portion, the blade holder tool has a universal quality enabling it to be used with skate blades of a variety of sizes or lengths.

In one embodiment, the blade-engaging portion includes a flex beam configuration providing for an interference fit with the skate blade, wherein the interference fit provides sufficient force to hold the skate blade while permitting insertion and removal of the skate blade by pushing and pulling action of a user's hand. In another embodiment, the blade holder tool includes a pair of opposed pivoting members and a spring biasing the pivoting members to a closed position, and the blade-engaging portion includes inner surfaces at respective ends of the pivoting members providing a pinching force to hold the skate blade.

In other aspects, the blade holder tool may include features for positioning and orienting the skate blade to the blade holder tool, and/or for positioning and orienting the blade holder tool to the sharpener unit. The features may include mechanical features and/or graphical indicators.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Figure 1:
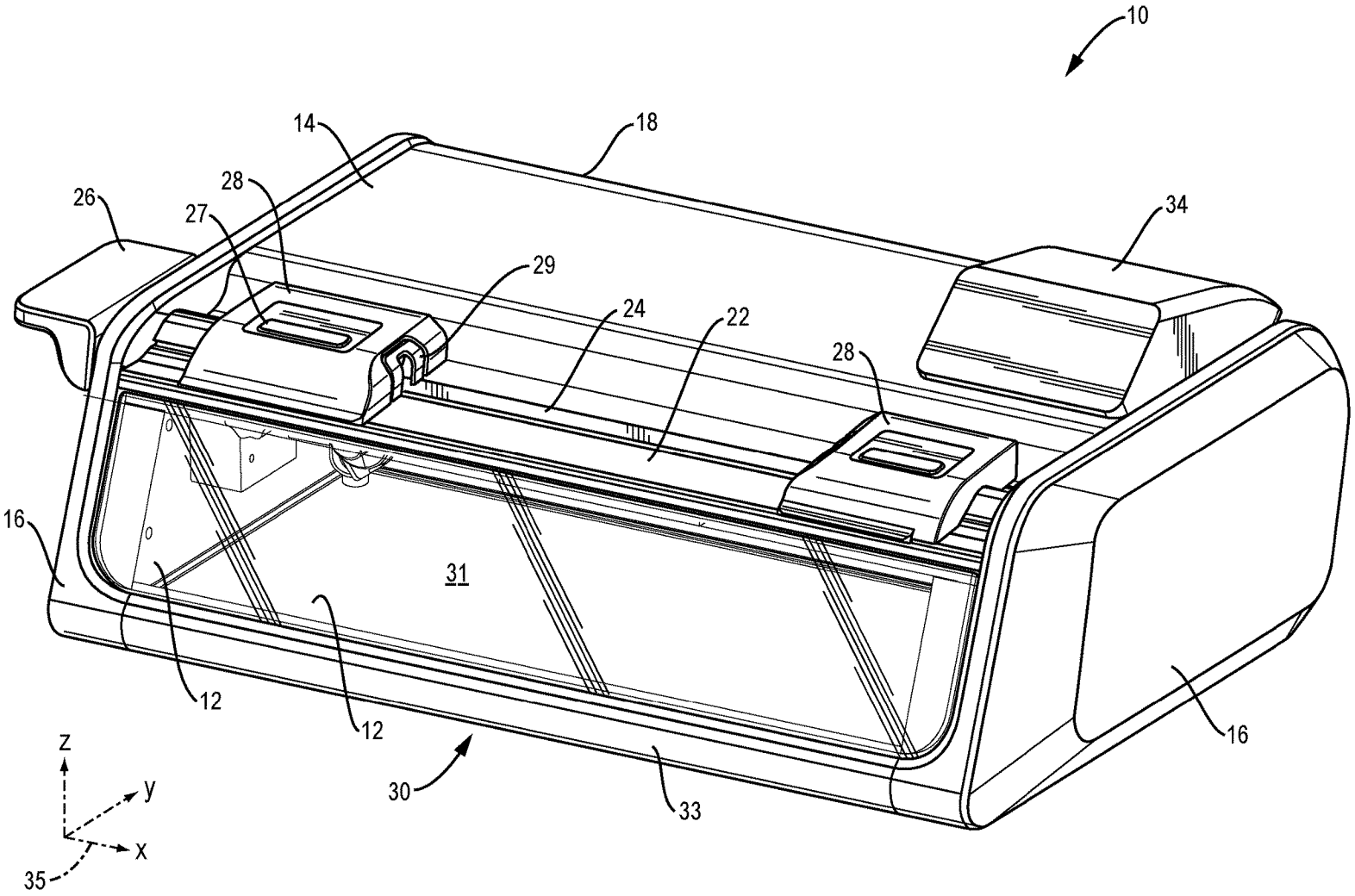
FIG. 1 is a perspective view of a skate sharpening system.

FIG. 1 is a perspective view of a skate sharpener 10, also referred to as a "sharpener unit", used to sharpen the blades of ice skates. It has a box-like housing with structural elements including a rigid frame 12 (bottom visible in FIG. 1) and a rigid chassis 14. Attached components include end caps 16 and a rear cover 18. The chassis 14 includes a front platform portion 22, also referred to as "platform" 22 herein. The platform 22 includes an elongated slot 24 for receiving the blade of an ice skate for sharpening, and the blade is retained by clamp jaws (not shown) on the underside of the platform 22 which are actuated by a mechanism including a clamp paddle 26. Disposed on the platform 22 are slot covers or "scoops" 28 at respective ends of the slot 24, each including a respective bumper 29 serving to sense contact with a skate blade holder. An outward-opening door 30 having a glass panel 31 and lower hinge portion 33 extends across a front opening. A user interface display panel 34 is disposed at top right on the chassis 14. The skate sharpener 10 also includes a control module or controller, which is not visible in FIG. 1 and may be located, for example, inside of the rear cover 18. Further mechanical and electrical details are provided below.

FIG. 1 also shows a coordinate system 35 for references to spatial directions herein. The X direction is left-to-right, the Y direction front-to-back, and the Z direction bottom-to-top with respect to the skate sharpener 10 in the upright, front-facing orientation of FIG. 1. This coordinate system also defines an X-Y plane (horizontal), X-Z plane (vertical and left-to-right), and Y-Z plane (vertical and front-to-back). Using this coordinate system 35, the slot 24 extends in the X direction and the skate blade is clamped in an X-Z plane during sharpening as described more below.

While this description includes a sharpening system such as that of FIG. 1 that operates in an automated fashion, the need to manipulate and properly load a loose skate blade in a sharpening system is relatively independent of the type of sharpener. Thus, aspects of the present disclosure are also applicable to manual sharpening systems that lack automated control of a sharpening operation.

Figure 2:
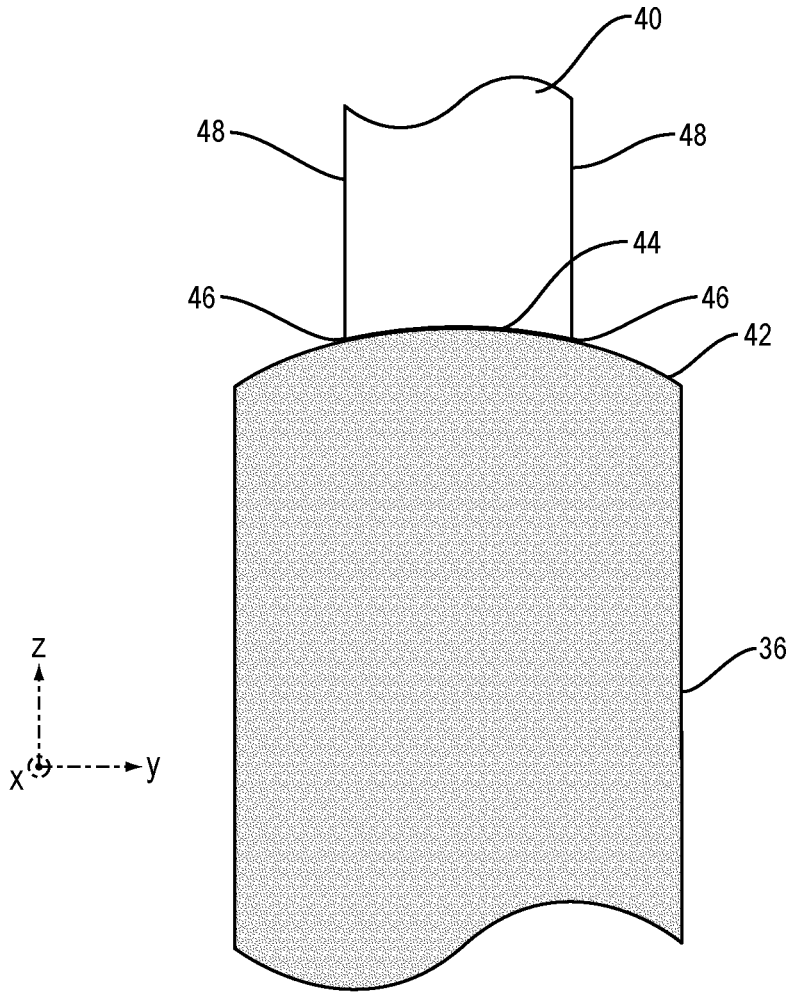
FIG. 2 is a schematic depiction of a grinding wheel contacting a skate blade during sharpening.

FIG. 2 depicts how a skate blade is sharpened. This is a schematic edge-on view of a lower portion of a skate blade 40 in contact with an outer edge of a grinding wheel 36. With reference to the coordinate system 35, this is a view in the X direction. As shown, the grinding wheel 36 has a convex rounded grinding edge 42. In practice the grinding edge 42 may be generally hemispherical. The grinding wheel 36 rotates in the plane of the blade 40 (X-Z plane, into the paper in FIG. 2), thereby imparting a corresponding concave rounded shape to a lower face 44 of the skate blade 40. Two acute edges 46 are formed at the intersection of the curved lower face 44 and the respective sides 48 of the blade 40. As material is removed, a clean and precise arcuate shape is restored to the lower face 44, including sharper edges 46. In practice, the radius of curvature of the lower face 44 is in the general range of ⅜" to 1", with one generally preferred radius being ½".

It will be appreciated that the disclosed methods and apparatus may be used with other blade profiles, including flat and V-shaped, for example.

Returning to FIG. 1, basic operation with a complete skate is as follows. The user clamps the blade 40 of a skate in the slot 24 and slides the slot covers 28 inwardly until the bumpers 29 are engaged by a blade holder part of the skate. Each bumper 29 actuates a limit switch within the respective slot cover 28, so that the engagement is sensed by the controller to enable sharpening to proceed. The user then interacts with a user interface presented on the display panel 34 to initiate a sharpening operation. Subject to certain conditions as described more below, control circuitry of the control unit automatically operates both a grinding motor to spin a grinding wheel and a separate carriage motor (described briefly below) to move the rotating grinding wheel back and forth along the lower face of the skate blade a desired number of times. Upon completion of a desired number of passes, the control unit stops both the rotation and back-and-forth motion of the wheel 36, and the user unclamps and removes the skate blade from the sharpener 10.

The above operation may also be used with bare removable skate blades of the type known in the art. In this case a blade holder tool is used to enable a user to position the bare blade in the slot 24 for clamping and to engage the bumpers 29 of the slot covers 28 to permit operation. Further below is an extensive description of such blade holder tools and their use.

Figure 3:
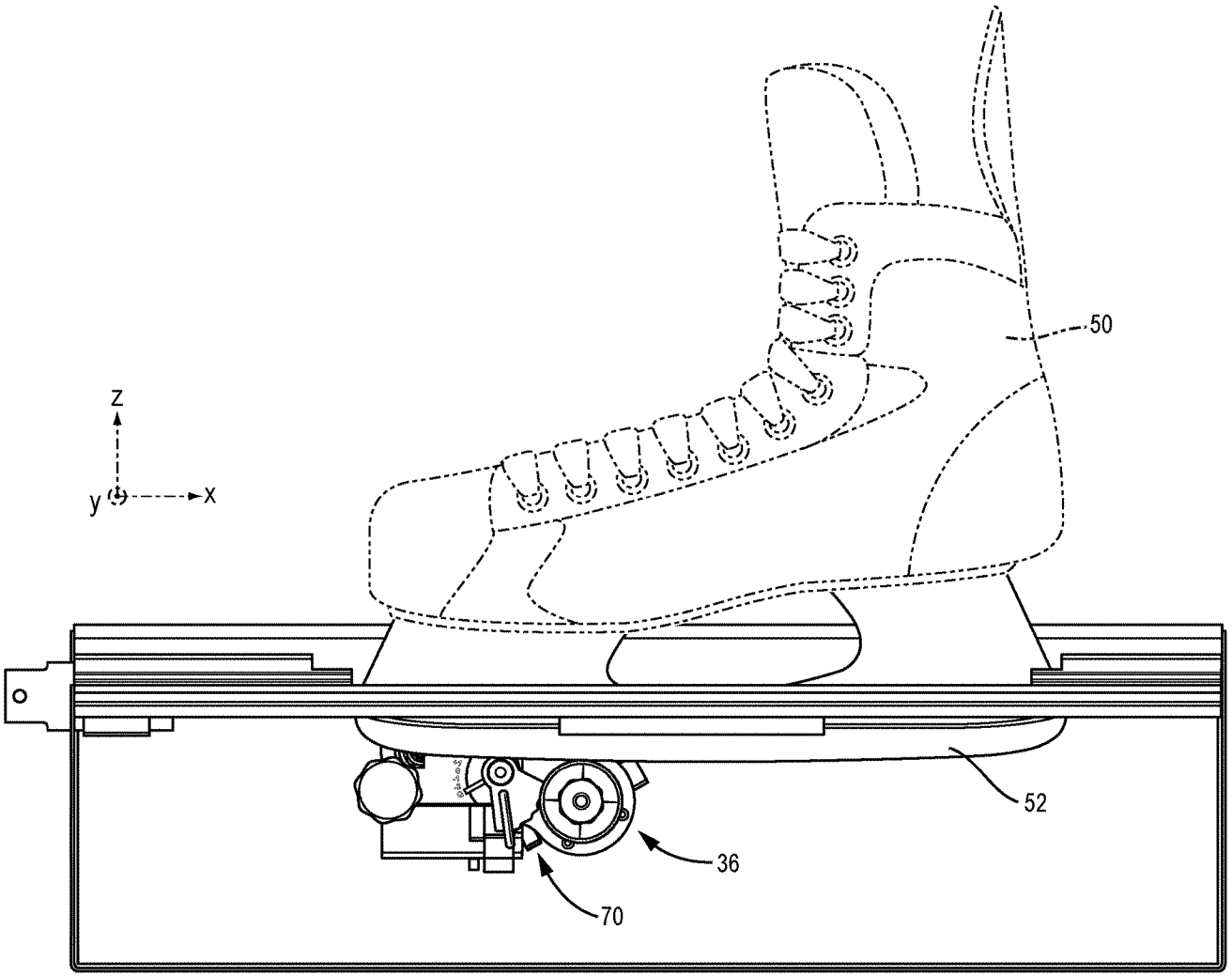
FIG. 3 is a front elevation view of a sharpening system.

FIG. 3 is a front view illustrating the sharpening operation for a complete skate as described above. A skate 50 is present and its blade 52 is clamped into a sharpening position in which the lower portion of the blade 52 extends downward through the slot 24 (FIG. 1) into the interior of the sharpener 10. FIG. 3 shows an internal carriage assembly 70 and grinding wheel 36 in the middle of a pass. It can be seen that the grinding wheel 36 just touches the lower edge of the blade 52, and it follows the profile of the blade 52 throughout each pass. Generally multiple passes are used in a sharpening operation for a given blade 52, with the number of passes being determined by the amount of material removal that is necessary to achieve desired sharpness. The sharpener may use both left-to-right and right-to-left passes in sequence, i.e., the grinding wheel 36 travels back and forth in contact with the blade 52 in both directions. Assuming a single home position at one end, in practice each sharpening operation may have a number of two-pass cycles, each including a pass in one direction and a pass in the opposite direction. In alternative embodiments sharpening may occur in only one direction, i.e., the grinding wheel 36 is in contact with the skate blade 52 only for passes in one direction, which alternate with non-sharpening return passes in the other direction.

Figure 4:
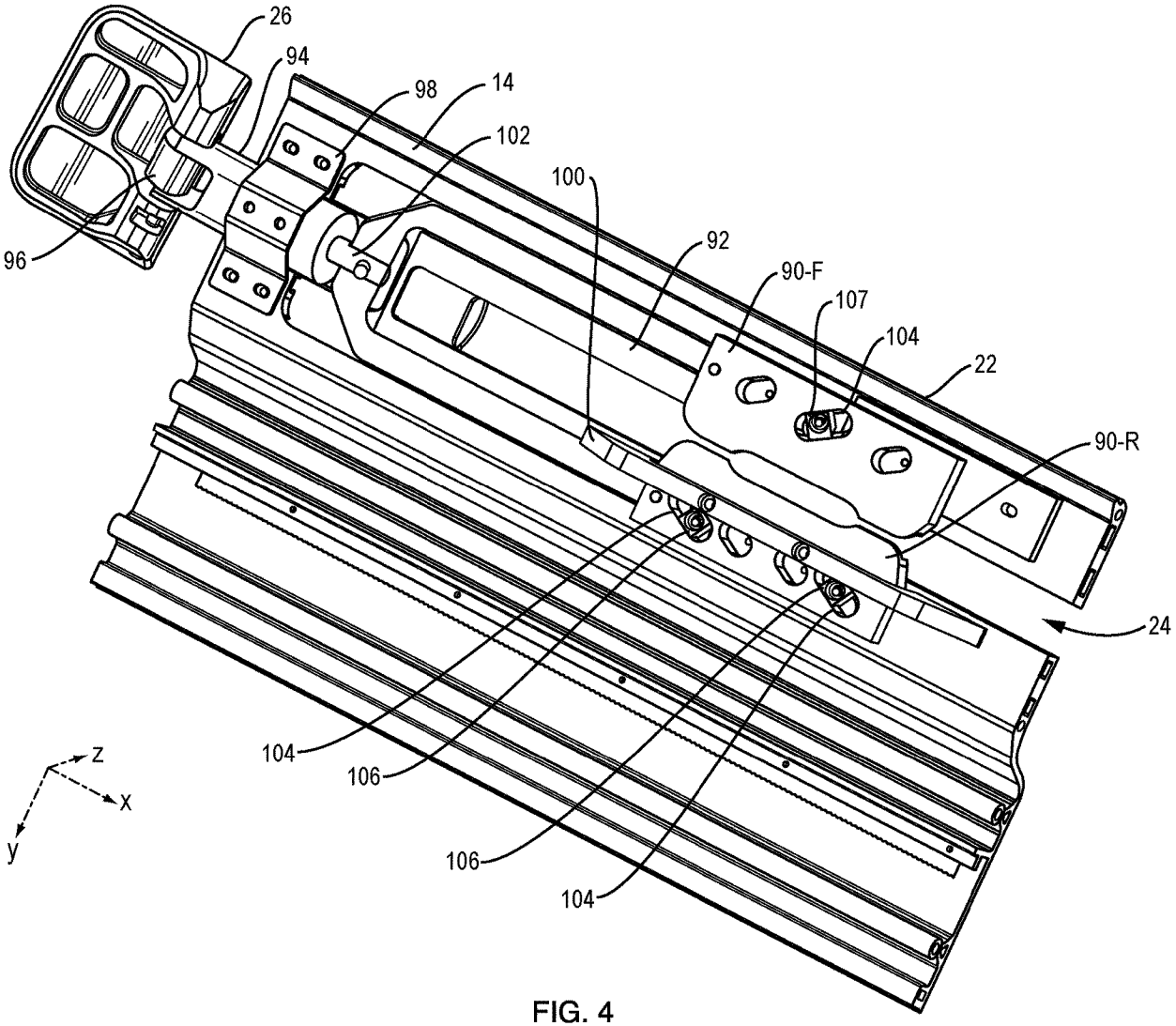
FIG. 4 is a perspective view of a skate blade clamp.

FIG. 4 shows the underside of the chassis 14. It includes a skate blade clamping mechanism whose major components are a pair of clamp jaws 90, specifically a front jaw 90-F and a rear jaw 90-R; a pull rod fork 92; a clamp cylinder 94; and a cam 96 at the underside of the clamp paddle 26 that rotates therewith. The clamp cylinder 94 is retained by a bracket 98. Also shown is a jaw guard 100. The clamp cylinder 94 has a pull rod 102 connected to the pull rod fork 92 and an internal spring-piston arrangement that actuates the pull rod 102 and thus the jaws 90 via the pull rod fork 92.

As shown, the jaws 90 each include angled slots 104, and in the slots 104 are arranged rectangular guide blocks 106, 107 that retain the jaws 90 at the underside of the platform 22 with spacing to permit the jaws 90 to slide in the long direction of the slots 104.

When the clamp paddle 26 is in the position shown in both FIG. 4 and FIG. 1, i.e., extending horizontally away from the platform 22, the lobe of the cam 96 does not engage the internal piston of the clamp cylinder 94, and the action of the internal spring is to retract the pull rod 102 (toward the left in FIG. 4) so that the jaws 90 are brought toward each other by action of the angled slots 104 and guide blocks 106, 107. This is a referred to as a "closed" position, in which the jaws 90 are either just touching each other or are only slightly spaced apart, less than the width of the thinnest skate blade to be sharpened. Because this position is created by the spring alone, it is referred to as a "biased closed" position.

When a skate blade is to be clamped for sharpening, a user rotates the clamp paddle 26 to open the jaws 90. Referring to FIG. 1, the user pushes downward on the outer part of the clamp paddle 26. In FIG. 4, the clamp handle 26 rotates out of the page, rotating the cam 96 accordingly and causing it to push against the piston within the clamp cylinder 94. This force works against the spring bias to extend the pull rod 102 and push on the jaws 90, causing them to move away from each other by action of the angled slots 104 and guide blocks 106, 107. The space between the jaws in the open position is wider than the widest skate blade to be sharpened. The cam 96 and head of the piston may be co-configured to establish a detent with the jaws in the fully open position. The skate blade is then inserted through the slot 24 between the jaws 90, and the user then rotates the clamp paddle 26 upwardly (FIG. 1) to close the jaws 90 on the skate blade. It will be appreciated that the front jaw 90-F automatically rotates as necessary to close snugly against the skate blade with balanced force across the length of the jaws 90. In the absence of this rotating feature, any imperfection in alignment of the jaws 90 could create undesirable binding and/or rotational skewing of the skate blade, adversely affecting sharpening operation.

The jaw guard 100 protects against the possibility of contact between the grinding wheel 36 and the jaws 90. If the skate sharpener 10 were to somehow be operated without a skate blade present, then without the jaw guard 100 the wheel 36 would move across the jaws 90 at its upper vertical limit position, potentially damaging the grinding wheel 36 and/or the jaws 90. This is prevented by the jaw guard 100, which would be encountered by a spindle (not shown) and keep the grinding wheel 36 in a more downward position safely away from the jaws 90.

Figure 5:
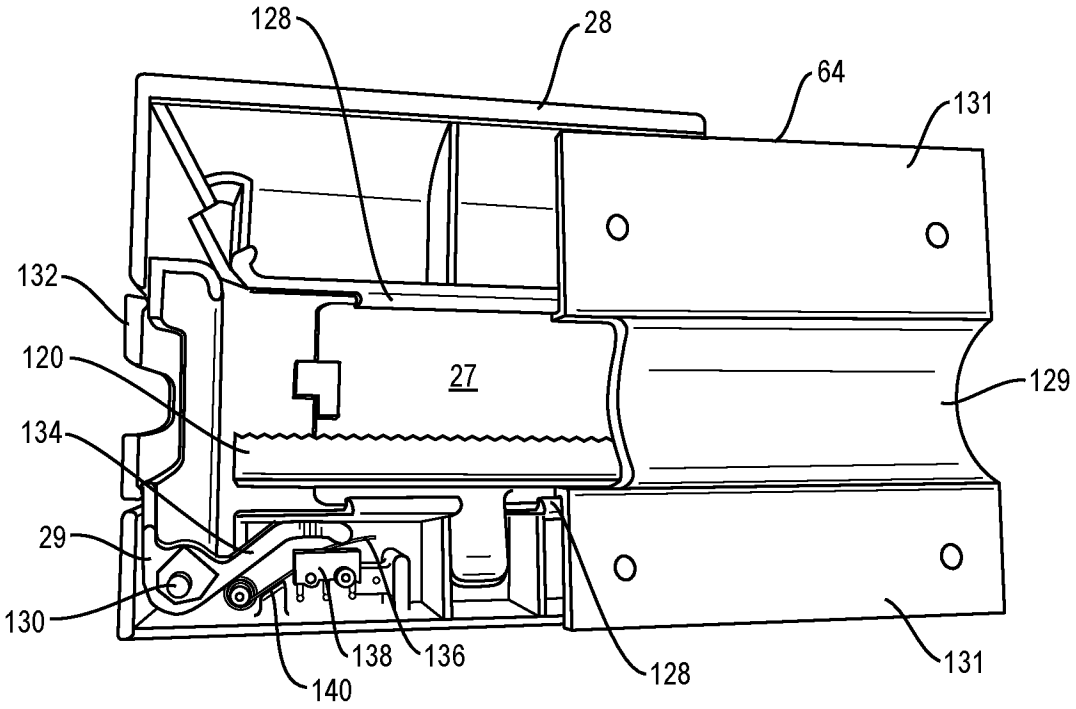
FIG. 5 is a bottom view of a slot cover.

FIG. 5 is a bottom view of a slot cover 28 and an arch 64 on which it is captured, the arch 64 being attached to the chassis 14 (FIG. 1). The bottom of the button 27 is visible, including a rack 120 that moves in and out of the page in this view when the button 27 is operated as described above. The slot cover 28 is retained on the arch 64 by a latch-like rail mechanism including inner edges 128 of the slot cover 28 that fit within corresponding elongated grooves on the upper surface of the arch 64 where the central rounded portion 129 meets the lateral flat portions 131.

FIG. 5 shows the arch 64 as a distinct mechanical component, which in the illustrated embodiment is attached to platform portion 22 of the chassis 14. In alternative embodiments, the platform portion 22 may itself be formed (e.g., through molding, machining, etc.) to include arch-like portions serving the same purpose of retaining the slot covers 28.

In the illustrated embodiment, the bumper 29 is attached to the body of the slot cover 28 (at lower left corner in this view). The attachment is with a pin or similar fastener 130 that permits the bumper 29 to rotate. A face portion 132 contacts a skate blade holder in operation as described above (FIG. 1 and related description). Another portion 134 extends to an actuation lever 136 of a limit switch 138. The bumper 29 is biased (counterclockwise in this view) by a spring 140. The limit switch 138 is wired to the above-mentioned controller (not shown) to enable the controller to sense its electrical state (open or closed). The wires are omitted in FIG. 5 for ease of illustration.

In operation, the limit switch 138 is electrically open and mechanically open by default, due to the mechanical biasing action of the spring 140. When the face portion 132 of the bumper 29 is depressed, the bumper 29 rotates (clockwise in this view) and the arm 134 depresses the limit switch lever 136, electrically closing and mechanically closing the limit switch 138. The state of the limit switch 138 as open or closed is sensed by the controller. In one embodiment, sharpening operation is permitted only when the limit switch 138 is sensed as closed, which normally occurs when a skate blade is clamped in position and the slot covers 28 have been moved inward to contact the skate blade holder. In these operating positions the slot covers 28 cover the outer ends of the slot 24 that would otherwise be open. This prevents the introduction of any objects through the outer ends of the slot 24, where such objects might harmfully contact the rotating grinding wheel 36 as it moves along the slot 24 during a sharpening operation. If the limit switch 138 of either slot cover 28 is sensed as electrically open or mechanically open, which normally occurs when either a skate or blade holder tool is not present or both slot covers 28 have not been moved inward to their operating positions, the controller prevents sharpening operation, i.e., provides no electrical drive to the grinding wheel motor and the carriage motor. With these motors not rotating, it is safer to introduce objects (such as a skate blade during mounting, for example) into the slot 24.

There are various alternatives to the configuration described above. An alternative to the bumper 29 may be a piston-like mechanism that moves linearly to actuate a switch, instead of rotating about a fixed pivot point as in the above. More generally, the slot covers 28 may include respective mechanical members that translate mechanical contact with the skate blade holder to actuation of a switch or similar sensor. Additionally, it is not necessary to use a limit switch with an actuation lever—in an alternative arrangement the bumper 29 (or analogous member) may directly push on the button of a limit switch. Also, in some embodiments a separate spring 140 may not be required. It may be possible to rely on the spring of a limit switch to provide a bias or return force. However, it may be desirable to use a separate spring to provide for adjustment of either/both the range of motion and actuation force of the bumper.

Regarding the limit switch 138, there may be different specifics in alternative embodiments. The key function is that contact with a skate toggle, both mechanically and electrically, the state of a switch or other sensor. In an alternative embodiment, a contactless sensor such as an optical emitter-detector pair could be used, with the skate or blade holder tool breaking the optical path to trigger the sensor.

In the illustrated embodiment the slot covers 28 are affixed and always present, but in an alternative embodiment they could be separate components that are placed and locked onto the ends of the skate or blade holder tool by the user prior to sharpening. Also, while in the illustrated embodiment the slot covers 28 move by sliding, they could alternatively move by rotating on a hinge, telescoping, or rolling out (like a breadbox or garage door). Certain details and alternatives are described more fully below.

As described above with reference to FIG. 3, the sharpener unit 10 may be used to sharpen the blades of "complete" skates, i.e., skates with blades that are removed either with difficulty or not at all. For example, the blade may be secured to a blade holder portion (typically molded plastic) which is mounted to an upper skate boot. Historically, the method to secure the blade to the blade holder portion has used fasteners that clamp or pull the blade into or against the blade holder portion. There are other configurations where the blade is molded into the blade holder portion and is not separable therefrom.

Figure 6:
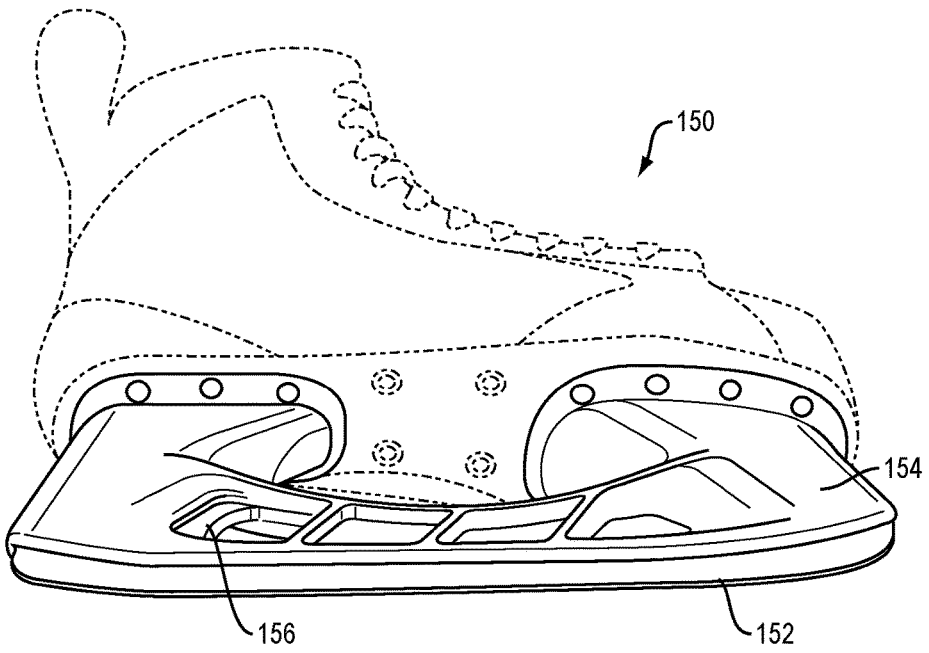
FIG. 6 is a diagram an ice skate.

FIG. 6 shows a newer type of skate 150 in which the blade 152 is removable from the holder portion 154 with very little difficulty, in some cases without even requiring any tools. The blade 152 is retained in the holder portion 154 using a spring-loaded retention member having a release button 156 in the heel area.

Figure 7:
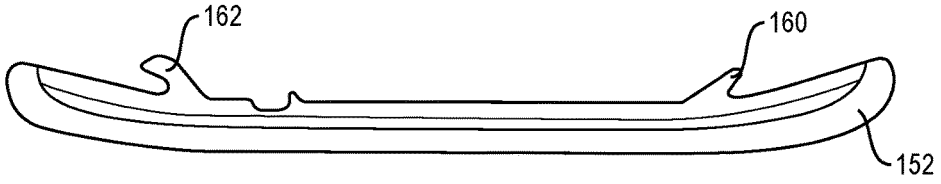
FIG. 7 is a diagram of a skate blade.

FIG. 7 illustrates a skate blade 152 apart from the remainder of the skate 150, also referred to as a "loose" blade 152 herein. As shown, the blade 152 has front and rear upper protrusions 160, 162. The front protrusion 160 is captured by a fixed crosspiece (not shown) inside the toe area of the skate blade holder 154, and the rear protrusion 162 is captured by the spring-loaded retention member inside the heel area (also not shown). To install the blade 152, a user places the front part into the toe area of the blade holder portion 154 (FIG. 6) and then pivots the rear part of the blade 152 into the heel area. The internal retention member allows entry of the rear protrusion 162 and then snaps back into place to capture the rear protrusion 162 and lock the blade 152 in place. To remove the blade 152, the user pulls back on the release button 156 to open the internal retention member, then performs the opposite motions on the blade 152—pivoting it downward away from the heel area, then pulling it out of the toe area.

One benefit of tool-less blade insertion/removal is that equipment managers, coaches, and players can easily swap out blades if desired while playing. Because of the ease of removing the blade, the blade can be swapped quickly during or after a skating session. Another advantage is that a player can keep one or more extra pairs of skate blades in his/her equipment bag, potentially reducing the frequency with which the player would need to visit an ice skate sharpener, and reducing the chances that a player will experience sharpening issues while traveling away from home to play.

The increasing use of removable blades such as blade 152 presents new challenges with respect to blade sharpening. First is a functional challenge—the need to sharpen a loose blade rather than a blade attached to a skate. More generally, players at all levels, including those who might not own multiple pairs of skates, may prefer to own several pairs of blades and swap them as often as they need to. This increases demand for sharpening, including at sub-professional levels where players are becoming more accustomed to always having sharp edges when playing.

Further with respect to the functional challenge—sharpening a loose skate blade—a user of a skate sharpening machine cannot easily and accurately load a loose skate blade into most skate sharpeners, specifically into their blade clamps. The blade clamp is the fixture that securely grips the skate blade in the skate sharpening machine, holding it during the sharpening process. The difficulty arises partly due to the short vertical height of the blade and the relative lack of area for a user to grasp the blade when loading it into the clamp. A user may pinch or otherwise injure his/her fingers when securing a loose skate blade to a blade clamp.

These challenges of loading a loose skate blade into the skate clamp are exacerbated when dealing with automated, vertical mount configuration skate sharpeners, including the sharpener unit 10 of FIG. 1. In these machines, the jaws that clamp the skate blade can be recessed, creating interference with the user's fingers when lowering the blade into the clamp. In some of these machines there also may not be any structure acting as a vertical (Z direction) stop for the blade. This lack of vertical stop increases the complexity of loading a loose blade, as the loose blade could be dropped into the enclosure of the skate sharpener. This might require that the sharpening machine be disassembled to retrieve the loose skate blade.

Additionally, the quality of the sharpening by a vertical mount machine can be affected by the vertical (Z-direction) location of the skate blade in the clamp. The vertical location of the skate blade can dictate the amount of force that will be applied to the skate blade by the grinding wheel. Thus, a user can negatively affect the quality of the skate sharpening by inserting a loose skate blade at an improper vertical position. A related aspect is the "pitch" of the blade, i.e., its rotational position about the Y axis. It is preferable for the blade to be substantially horizontal, so that proper contact and force exist between the grinding wheel and lower edge of the blade along its entire length. Improper rotational position can compromise these goals. When the blade of a complete skate is being sharpened, e.g. skate 150 of FIG. 6, there can be a beneficial contact between the bottom of the blade holder portion 154 and the clamp, serving to automatically locate the blade 152 at a desired Z-axis position and with desired Y-axis rotational position. This feature is absent when sharpening a loose skate blade.

Yet another challenge when loading a loose skate blade in existing blade clamp mechanisms is difficulty centering the skate blade in the X direction on the jaws of the clamp mechanism. This is due to the loose skate blade being less visible than a complete skate, and thus providing less of a visual cue that the skate blade is not centered. A non-centered skate blade can be problematic, because the blade may vibrate during sharpening if there is a long unsupported length outside of the clamp jaws. Such vibration would lower the quality of the sharpening. In the case of the vertical mount machines, a non-centered blade may cause the contact length for the grinding wheel to be altered in such a way that the skate blade is not sharpened along its entire length, or it may result in the grinding wheel changing its translation direction relative to the skate blade while still in contact with the skate blade, potentially damaging the blade.

Finally, most skate sharpening machines have a recommended X-direction orientation for securing the skate blade in the blade clamp, i.e., heel/toe direction relative to the machine. The proper heel/toe orientation of a loose skate blade may not be obvious to a user, as there is no skate boot to use as a reference. If a skate blade is loaded backwards in the clamp, the sharpener will operate differently than the manufacturer of the sharpener intended. This could result in a difference in the quality of the sharpening.

In summary, there are a number of challenges and problems associated with existing machines and techniques with respect to sharpening loose skate blades. These include:

1. The user can pinch their fingers in the clamp when holding the skate blade in place while securing it.

2. A gap is left around the separate skate blade that give users access to moving components in the sharpener. This gap would normally be covered by the blade holder and boot of the skate.

3. The skate blade could fall out of the clamp or have less retention force than needed on account of the skate blade being misaligned during installation. A misaligned skate blade could impact the quality of the sharpening as the skate blade may vibrate or move when the grinding wheel touches it during sharpening.

4. The skate blade could be dropped into a vertical mount sharpener enclosure.

5. The skate blade could be placed in an incorrect vertical location, non-centered (X-direction) location, incorrect y-axis rotation position, and/or incorrect heel/toe orientation, adversely affecting the quality of the sharpening.

There are known devices for holding loose skate blades, but not in connection with a sharpener unit such as the sharpener unit 10 of FIG. 1 which has both recessed clamping jaws 90 (FIG. 4) and the protective slot covers 28 that are meant to be engaged by the blade holder portion 154 of a complete skate. Known devices can neither place a loose skate blade 152 low enough nor provide the needed mechanical engagement with the bumpers 29 of the slot covers 28. Also, known holding devices do not address (either fully or at all) the problems of improper locating, centering and orienting as outlined above.

It is believed that a good solution for sharpening loose skate blades would have some or all the following features:

1. Rapid connection/disconnection to a loose skate blade of arbitrary size, while providing sufficient retention force to securely retain the skate blade 2. Keeping a user's hands at a safe distance when securing a loose skate blade to a blade clamp in a sharpener unit 3. Blocking the open area around a loose skate blade to guard against accidental contact with moving parts in the sharpener.

4. A profile to fit through a narrow opening at a top of a vertical mount machine place the skate blade down into a recessed blade clamp 5. Alignment features to assist a user with attaining proper depth, centering, y-axis rotation, and orientation (heel/toe)

6. Interface with safety switches in protective slot covers (e.g., in slot covers 28)

A good solution is also preferably of relatively simple and low-cost design and manufacture.

The above issues and goals are addressed by a blade holder tool as described herein. Several different embodiments are described, having most/all of the following desirable features:

1. Securely hold the skate blade, enabling accurate positioning and minimizing the risk of dropping the blade into a vertical-mount sharpener unit such as unit 10.

2. Slim profile that fits into the slot that receives the skate blade, and in some cases also fits between the clamping jaws to aid in locating and orienting the blade.

3. Alignment features that index the proper depth and y-axis rotation of the skate blade so that it is secured in the clamp at the desired vertical location.

4. Centering features that aid a user in placing the skate blade into the blade holder tool itself and into the clamp in a centered fashion.

5. Orientation features or markings that aid a user in placing the skate blade into the blade holder tool itself and into the clamp in the proper heel/toe orientation.

6. Features that engage with guards and/or safety switches of the sharpener unit, such as the slot covers 28 of unit 10, providing a safety interlock on operation Additionally, it is desirable that a blade holder tool be usable with skate blades of a variety of sizes across a size range.

Figure 8:
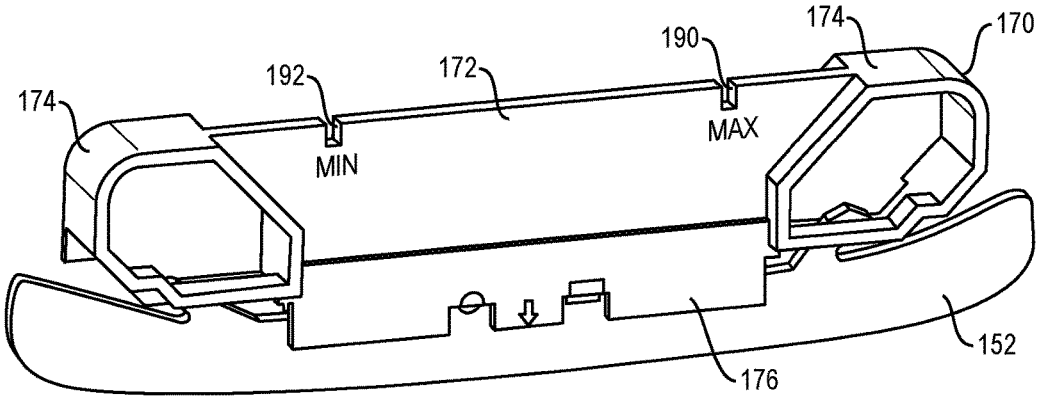
FIG. 8 is a perspective view of a blade holder tool with attached skate blade.

FIG. 8 shows a blade holder tool 170 holding a loose skate blade 152. The blade holder tool 170 is made of a generally stiff plastic material, while providing sufficient flex to grip the skate blade 152 as described more below. It has a flat, vertically-oriented central portion 172 and endward ring-like portions 174. An upper part of the central portion 172 is graspable by a user to enable the user to place the blade holder tool 170 in an inserted position while the blade holder tool 170 is holding the skate blade 152, thereby placing the skate blade 152 in a sharpening position where it is retained by the blade retention jaws 90 for sharpening, as described more below. A lower part of the central portion 172 is a blade-engaging portion 176 that grips the top of the skate blade 152. The ring-like portions 174 have lower slots to provide clearance for the protrusions 160,162 of the skate blade 152. Also, the ring-like portions 174 partially mimic the blade holder portion 154 of a complete skate, contacting the bumpers 29 of the slot covers 28 when the blade holder tool 170 is holding a clamped blade 152. As described more below, this contact trips or actuates the limit switches 138 of the slot covers 28. The ring-like portions 174 also block the open area of the slot 24 around the loose skate blade 152 and the jaws 90 to make sure a user's fingers cannot touch moving parts.

The ring shape and structure of the ring-like portions 174 at the ends of the blade holder tool 170 may aid in the moldability of the plastic. Alternative embodiments may employ other configurations of the ends of the blade holder tool 170.

Figure 9:
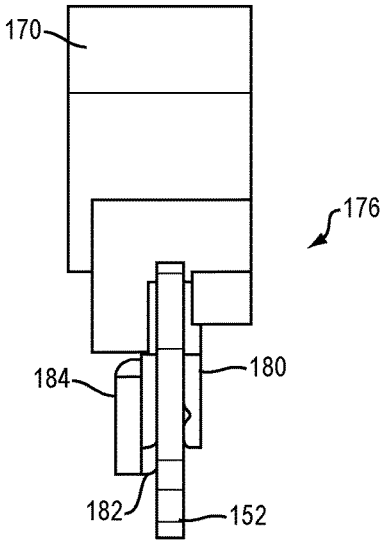
FIGS. 9-10 are on-edge views of a blade holder tool with attached skate blade.

FIG. 9 is an on-edge view showing the clamp-like configuration of the blade-engaging portion 176. Specifically, it includes first and second downward extensions 180, 182 spaced apart by a precise amount, as described more below. A unit-engaging portion in the form of a jaw interface feature 184 extends away from the second extension 182, and is described more below. In use, the upper part of a skate blade 152 is pushed into the space between the extensions 180, 182, and is retained in place by mechanical interference therewith. One or both extensions 180, 182 may flex outwardly to accommodate the skate blade 152. For a thinnest blade 152, there may be minimal flexing and corresponding relatively low retention force. For thicker blades 152, there will be greater flexing and correspondingly higher retention forces. FIG. 9 also illustrates that the blade holder tool 170 has a slim profile that facilitates placement of the blade holder tool 170 in a narrow channel of a sharpener, such as the slot 24 (FIG. 1). In one example, the blade holder tool 170 has a total width of less than 10 mm in the area where the blade holder tool 170 drops down into the clamp jaws as described more below.

As the blade-engaging portion 176 utilizes a simple interference fit and flex beam configuration to grip the skate blade 152, the design is free from any complicated clamping mechanisms. It can be manufactured using typical plastic-molding techniques, providing for low cost. The simple design also provides for rapid connection of the skate blade 152—a user simply inserts the desired skate blade 152 into the blade-engaging portion 176 from below. The interference fit provides sufficient force to hold the skate blade 152 while permitting insertion and removal of the skate blade by pushing and pulling action of a user's hand. The force is generally less than 12 pounds, and more specifically less than 5 pounds. A preferred range of push/pull force for adequate grasp of the blade 152 and simple hand insertion and removal is between 1 and 3 pounds. In one embodiment, the force may be in the range of 1.5 to 2 pounds.

Figure 10:
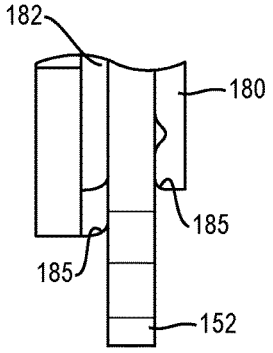

FIG. 10 is a more close-up view showing that inner edges 185 of the extensions 180, 182 may be rounded or chamfered to provide for smooth blade insertion.

Referring back to FIG. 8, the blade holder tool 170 also includes two thickness gauges 190, 192 formed as notches at the top of the central portion 172. A first gauge 190 is for maximum blade thickness, i.e., any skate blade 152 to be sharpened must thin enough to fit in this notch. A second gauge 192 is for minimum blade thickness, i.e., any skate blade 152 to be sharpened must be thick enough to not fit in this notch.

Below is blade thickness data (in inches) that has been gathered for skate blades of various types.

| Player | | Goalie | | Figure | |
|---|---|---|---|---|---|
| AVE | 0.11542 | AVE | 0.15614 | AVE | 0.14983 |
| STDEV | 0.003539 | STDEV | 0.00252 | STDEV | 0.007598 |
| RANGE | 0.01225 | RANGE | 0.01130 | RANGE | 0.02220 |
| MAX | 0.12195 | MAX | 0.15990 | MAX | 0.15940 |
| MIN | 0.10970 | MIN | 0.14860 | MIN | 0.13720 |

The above is a sampling of skates manufactured in 2014. It is possible that skates could be made in the future with different blade thicknesses, but the underlying principles as disclosed herein would remain.

Thus in general there will be a range of blade thicknesses to be accommodated, so an interference plus flexing design as described above is employed to grip the range of blade thicknesses seen for the type(s) of skate blades 152 to be accommodated. In one approach, there may be type-specific blade holder tools 170 for the different types of skates, e.g., a first type for player skates, another for goalie skates, and another for figure skates. In this case it will be appreciated from the above data that a player skate blade 152 would be identified as too thin for a blade holder tool 170 designed for a goalie or figure skate blade 152, and similarly goalie or figure skate blade 152 would be identified as too thick for a blade holder tool 170 designed for a player skate blade 152. Alternatively, a blade holder tool 170 may be designed with sufficient flex to adequately grip multiple types of blades 152.

The thickness gauges 190, 192 are optional and may not be present in all embodiments. One alternative to use of such thickness gauges is for the user to test the fit of the blade in the clamp, i.e., that the clamp can receive the blade (sufficiently thin) and adequately retain the blade (sufficiently thick).

It is noted that the upward-extending central portion 172 provides a sufficiently large area to enable a user to easily grip the blade holder tool 170 with his/her fingers. Also, because this portion 172 extends upwardly, the user's hand stays well above the top of the sharpener unit 10, away from the clamping and grinding components therein.

It is also noted that the blade holder tool 170 engages the skate blade 152 (both for gripping and aligning/orienting) at its center and not at its ends. Thus, the blade holder tool 170 may be used with blades 152 of a variety of different lengths (X-direction).

The blade holder tool 170 also includes alignment/orientation features including a blade centering (X-axis location) feature, a blade vertical positioning (Z-axis location) feature, a blade rotational positioning (angle about Y axis) feature, and a heel/toe orientation feature. The blade rotational features ensure that the bottom edge of the skate blade 152 is substantially horizontal in the sharpening position, so that the grinding wheel contacts the bottom edge along its length with a desired amount of normal force (see FIG. 3). These features are described in turn below. Alternative embodiments may include less than all three of these types of features.

Figure 11:
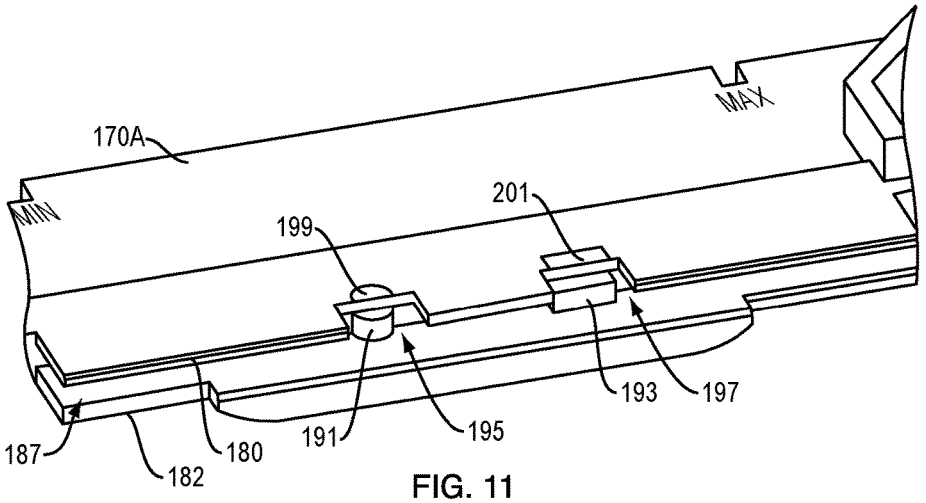
FIG. 11 is a perspective view of a blade-engaging portion of a blade holder tool.

FIG. 11 shows the bottom edge of a blade holder tool 170A. The extensions 180, 182 define a narrow elongated slot 187 that receives the upper part of a skate blade 152. A pair of alignment posts 191, 193 extend across the slot 187 between the two extensions 180, 182, with one post 191 having a circular cylindrical shape and the other post 193 having a rectangular cylindrical shape. Lower halves of the posts 191, 193 are visible in respective cutouts 195, 197 of extension 180. An outer semicircular face of the post 191 is marked for contrast with the surrounding material of the blade holder tool 170A, and similarly an outer rectangular face of the post 193 is marked for contrast with the surrounding material of the blade holder tool 170A. Matching semicircular and rectangular marks 199, 201 are also made at the upper edges of the cutouts 195, 197. When viewed from the side as explained more below, the marks together give the appearance of a single solid circle and a single solid rectangle.

Figure 12:
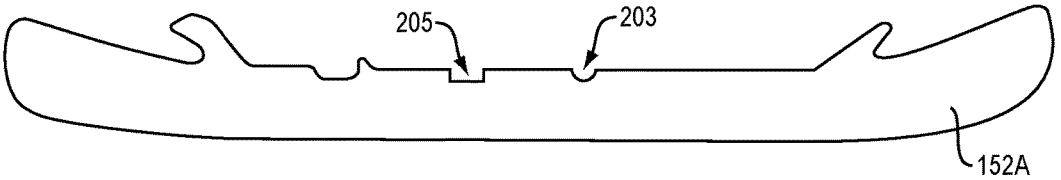
FIG. 12 is a diagram of a skate blade.

FIG. 12 is a view of a skate blade 152A that includes cutouts 203, 205 shaped to mate with the respective posts 191, 193. Specifically, the cutout 203 has a semicircular shape that mates with the lower half of the circular cylindrical post 191, and the cutout 205 has a semi-rectangular shape that mates with the lower half of the rectangular post 193. It will be appreciated that the cutouts 203, 205 along with the posts 191, 193 provide for both correct X-direction centering of the blade 152A with respect to the blade holder tool 170A as well as correct heel/toe orientation. With respect to centering, the blade 152A must be centered so that the members 199, 201 are properly aligned with the respective posts 191, 193 for mating therewith. With respect to heel/toe orientation, the different shapes (circular and rectangular) of the features 191, 193, 203, and 205 require that the blade 152A be oriented in a particular direction for proper mating—if the blade 152A is oriented in the opposite direction, the semicircular-shaped cutout 203 is incorrectly aligned with the rectangular post 193 instead of with the circular post 191, and the rectangular-shaped cutout 205 is incorrectly aligned with the circular post 191 instead of with the rectangular post 193. It will be appreciated that these features also establish a Y-axis rotational position of the skate blade 152 and the desired horizontal orientation of the bottom edge of the skate blade 152.

Figure 13:
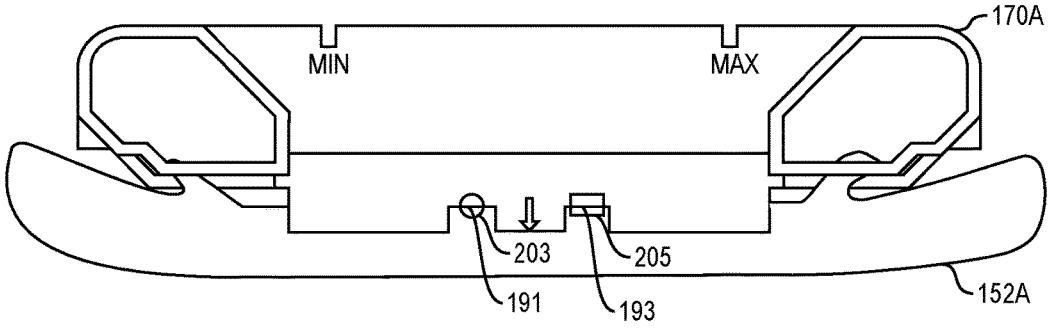
FIGS. 13-15 are views of a blade holder tool with attached skate blade.
Figure 14:
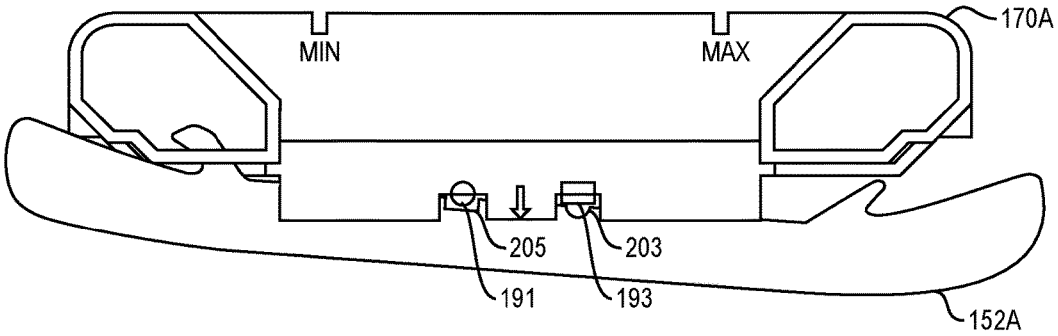

FIGS. 13 and 14 illustrate the use of the above-described features in centering and alignment. FIG. 13 shows the blade 152A fully inserted with proper centering and heel/toe orientation. The cutouts 203, 205 fully mate with the respective posts 191, 193. Also, the blade 152A is essentially parallel with the axis of the blade holder tool 170A, providing another visual cue to proper positioning. FIG. 14 shows the blade 152A inserted backward, i.e., with heel/toe positions incorrectly swapped. In this case, a visual indication of improper orientation is given by the juxtaposition of the rectangular-shaped cutout 205 with the circular post 191, as well as the juxtaposition of the semicircular-shaped cutout 203 with the rectangular post 193. Also, because the rectangular post 193 does not fit within the semicircular cutout 203, the blade 152A cannot be fully inserted and thus attains a tilted position with respect to the axis of the blade holder tool 170A, providing another visual cue of improper positioning.

It will be appreciated that the features 191, 193, 203, 205 also provide for vertical (Z direction) positioning of the skate blade 152A with respect to the blade holder tool 170A. The posts 191, 193 serve as vertical stops, against which the cutouts 203, 205 rest when the skate blade 152A is fully inserted. If the skate blade 152A is not fully inserted, a visual indication is provided by a break between the mark 199 and the marked face of post 191, and/or by a break between the mark 201 and the marked face of post 193.

In the above description, the blade holder tool 170A includes the posts 191, 193 and the skate blade 152A includes mating cutouts 203, 205. The positions of these features can be reversed in an alternative embodiment. The skate blade 152A can have one or more posts or analogous protrusions that made with corresponding cutouts formed in the blade holder tool 170A. In another example, the blade holder tool 170A may have one or more posts and one or more cutouts, while the skate blade 152A has corresponding cutout(s) and post(s) that mate with the respective posts and cutouts of the blade holder tool 170A.

Figure 15:
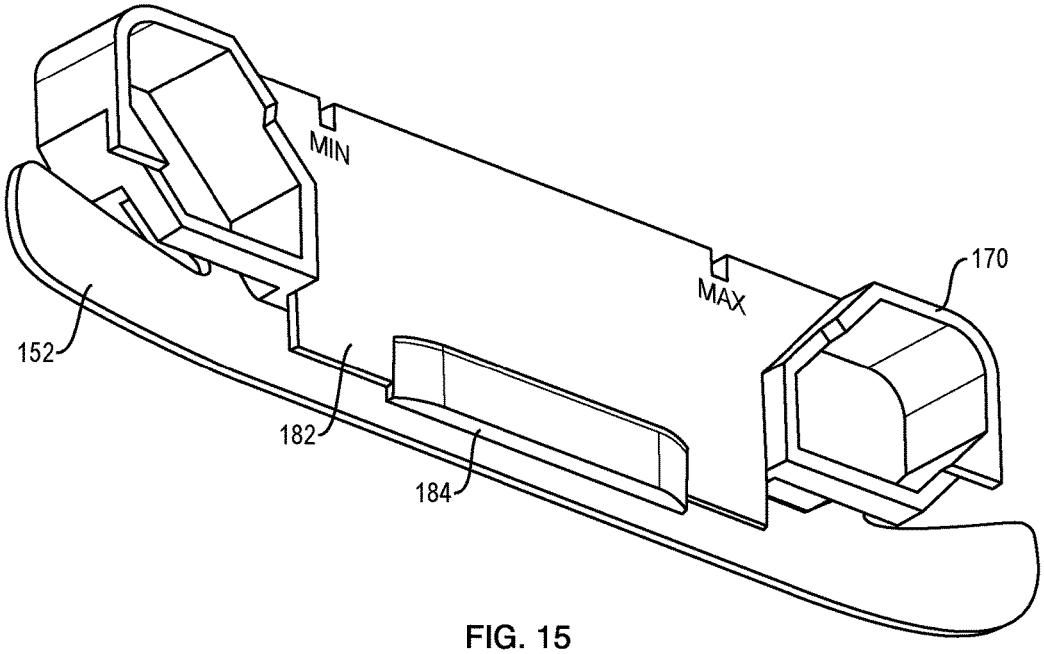
Figure 16:
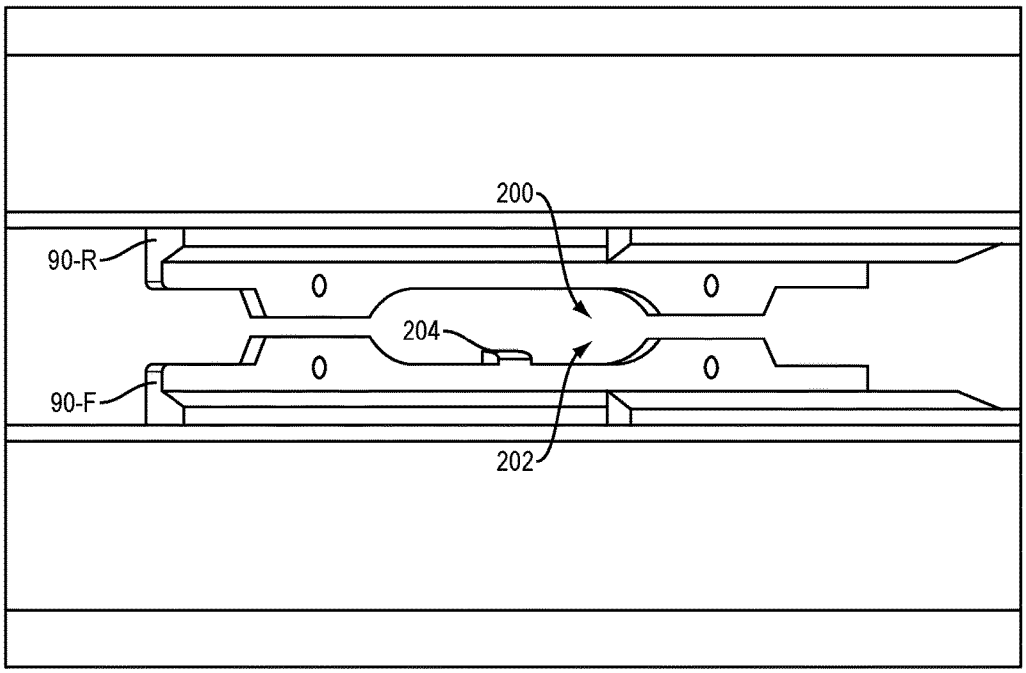
FIG. 16 is a top-down view of clamp jaws of a sharpener unit.
Figure 17:
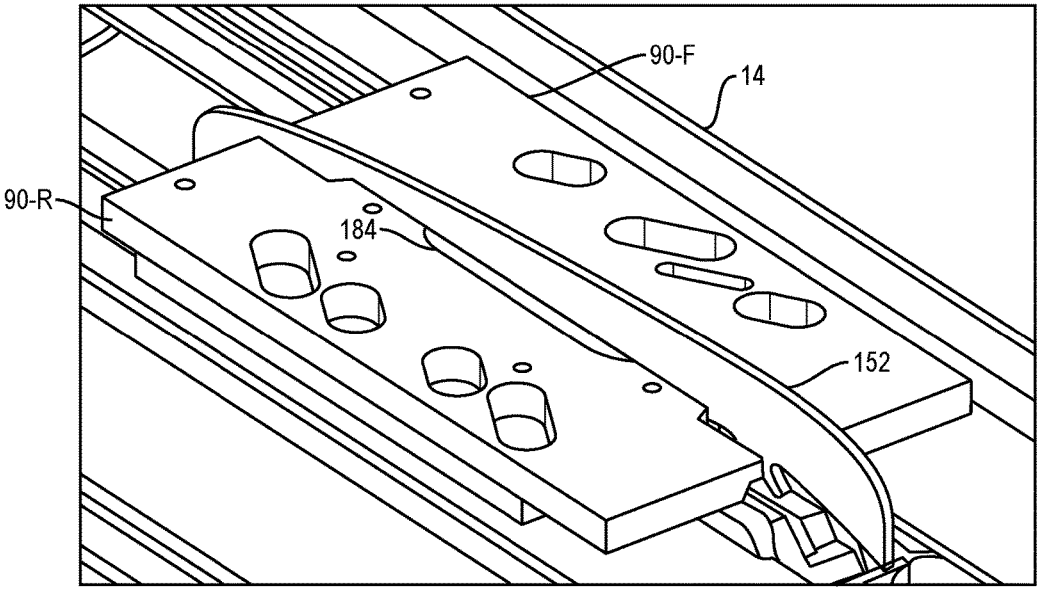
FIG. 17 is a bottom-up view of a skate blade with attached blade holder retained by clamp jaws.

FIGS. 15 through 17 illustrate how proper heel/toe orientation is carried to the sharpener 10. With the skate blade 152 properly oriented in the blade holder tool 170 as described above, it is necessary to ensure proper orientation of the blade holder tool 170 in the sharpener unit 10. This is provided by the jaw interface feature 184 and a corresponding co-configured shallow cutout in one of the jaws 90 of the sharpener unit 10. The result is illustrated in FIG. 17, in which the blade holder tool 170 occupies an inserted position to locate the skate blade 152 in the proper sharpening position for sharpening.

As shown in FIG. 15, the jaw interface feature 184 extends slightly beyond the lower edge of the extension 182. This feature is intended to mimic the position of the edge of the blade holder portion 154 of a complete skate 150. The jaws 90 are designed so that even at their maximum separation they do not accommodate the extensions 180, 182, i.e., there is interference so that the extensions 180, 182 rest on top of the jaws 90 rather than entering the space between them.

FIG. 16 is a top-down view of the jaws 90 showing respective cutouts 200, 202. The rear jaw 90-R has a smooth C-shaped inner edge bounding its cutout 200, while for the front jaw 90-F the corresponding edge is interrupted by a bump-out 204. Thus, the jaw interface feature 184 can be received by the cutout 200 of the rear jaw 90-R but not by the cutout 202 of the front jaw 90-F. This provides for proper orientation of the blade holder tool 170, as the inability of the blade holder tool 170 to be received by the front jaw 90-F prevents the blade holder tool 170 from achieving a locked position as described more below.

FIG. 17 is a bottom-up view illustrating that the jaw interface portion 184 is received by the cutout of the rear jaw 90-R. Although not apparent in this view, it will be appreciated that with the blade holder tool 170 in this locked position, the extensions 180, 182 (FIG. 9) rest against the upper surfaces of the respective jaws 90-F, 90-R and the blade holder tool 170 cannot be moved in the X direction.

The above-described configuration provides tactile feedback to the user during insertion of the blade holder tool 170. When the blade holder tool 170 is oriented properly, the user can slide the blade holder tool 170 in the X direction until the jaw interface portion 184 becomes aligned with the cutout 200 of the rear jaw 90-R, at which point the blade holder tool 170 falls slightly and become captured in the X direction. The user feels this movement and locking in place. Once this position has been achieved, the jaws 90 can be brought together to clamp the skate blade 152 firmly for sharpening. If the blade holder tool 170 is oriented incorrectly, it does not seat properly nor become captured in the X direction. Once a user is familiar with using the blade holder tool 170, the user will easily detect proper versus improper orientation.

Figure 18:
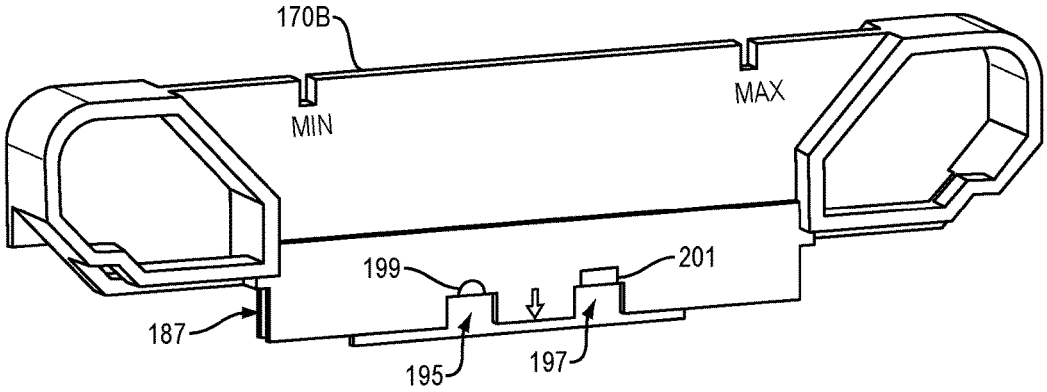
FIG. 18 is a perspective view of a blade holder tool.
Figure 19:
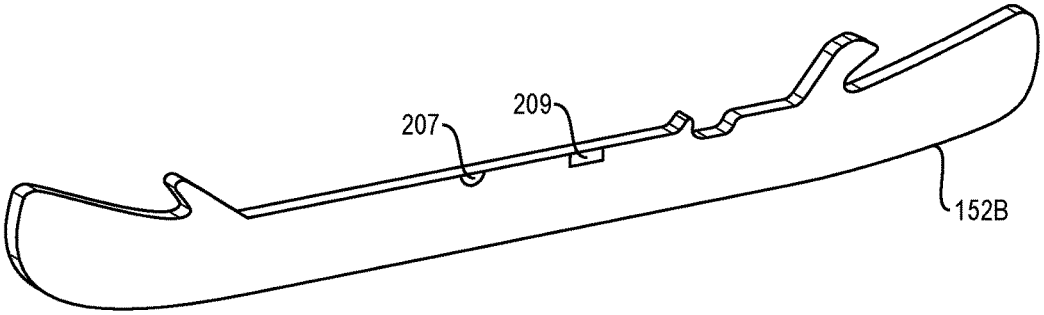
FIG. 19 is a diagram of a skate blade.

FIGS. 18 and 19 show an alternative embodiment employing a blade holder tool 170B and skate blade 152B, which are generally similar to their counterparts 170A, 152A but employ slightly different centering/orientation features. Specifically, the blade holder tool 170B includes the marks 199, 201 at the edges of the cutouts 195, 197, but omits the posts 191, 193. The skate blade 152B has corresponding marks 207, 209 and omits the cutouts 203, 205. Visually, correct insertion of the skate blade 152B into blade holder tool 170B may look similar to the view of FIG. 13. If the skate blade 152B is either improperly centered or not fully inserted, then the pairs of marks (199, 207) and (201, 209) will not form a perfect circle and rectangle. In one embodiment, the opposite surface of the skate blade 152B as no marks on it, so that if the skate blade 152B has improper heel/toe orientation, then again no perfect circle and rectangle are formed. In other embodiments, the opposite surface of the skate blade 152B might have marks that are not complementary with the marks 199, 201, providing a visual indication of improper orientation. Other marking schemes may be used that convey an indication of improper heel/toe orientation.

In the blade holder tool 170B, a vertical stop is provided by a surface bounding the upper extent of the slot 187, which may be coplanar with the upper edges of the cutouts 195, 197. The upper edge of the skate blade 152B rests against that surface when fully inserted, achieving a proper vertical (Z-direction) position.

While in the embodiments of FIGS. 11-14 and 18-19, the positioning features provide for both centering and orientation, in alternative embodiments there may be separate markings and/or mechanical features for each. Markings and mechanical features may be used together (e.g., as in FIGS. 11-14) or independently. Also, the cutouts 195, 197 serve as "windows" or indicators of the areas where a user views the marks/features, but in alternative embodiments such windows may be formed differently or not used at all.

When markings are used, they may be other shapes besides circular and rectangular. Also, it is not required to use half-shapes that become aligned, although half-shapes have an advantage in being intuitive to line up. The non-marked side of a skate blade 152 may include a printed note or other indication, which may be within an alignment window, instructing the user to flip the blade 152 over for proper installation in the blade holder tool 170.

Figure 20:
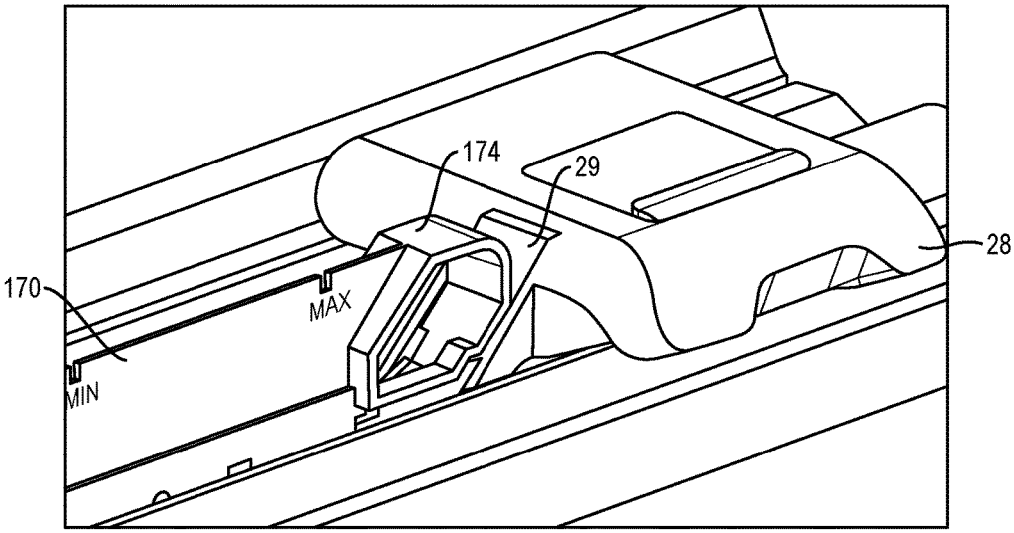
FIG. 20 is a view of an upper part of a sharpener unit with blade holder tool present.
Figure 21:
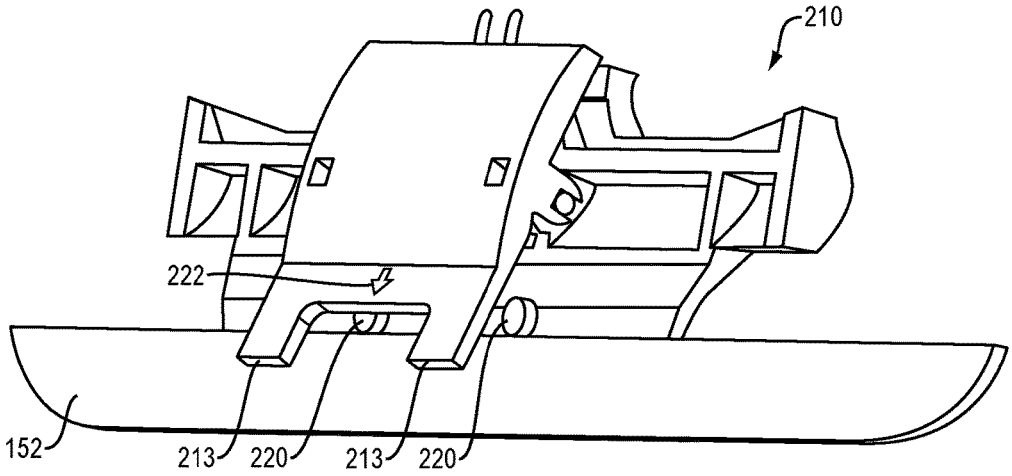
FIGS. 21-23 are views of another embodiment of a blade holder tool.

FIG. 20 shows blade holder tool 170 in the in-use or inserted position, i.e., still attached to the top of a skate blade 152 (not visible) that is clamped in the sharpener unit 10 for sharpening. The lower, blade-engaging portion of the blade holder tool 170 extends downward into the slot 24 (FIG. 1) and toward the jaws 90 and grinding wheel when operating. The upper part 172 of the blade holder tool 170, which is held by a user when placing the blade holder tool 170 into position, extends upwardly, i.e., away from the retention jaws 90 and the grinding wheel. As shown, the slot cover 28 has been moved inwardly to a position in which the bumper 29 is slightly depressed by contacting the endward ring-like portion 174. In the inserted position, the slot cover 28 covers a part of the slot 24 that would otherwise be open. The depression of the bumper 29 actuates the limit switch 138 as described above with reference to FIG. 5. FIG. 20 shows only the configuration at the right slot cover 28, but it will be appreciated that a similar configuration is obtained at the left slot cover 28 as well, which covers a respective part of the slot 24 that would otherwise be open.

The blade holder tool 170 may be designed to fit any length skate blade while also providing the necessary features to engage the bumpers 29 of the slot covers 28. In other words, regardless of the length of the skate blade 152, the blade holder tool 170 connects to the blade and also provides the structure to interface with the slot covers 28. Because the blade holder tool 170 only interfaces with the central portion of the blade 152, the slot covers 28 can be adjusted to cover the area above the blade outside the jaw clamping region. This limits access to help prevent external items, including a user's fingers for example, from contacting the jaws and/or grinding wheel during operation.

FIGS. 21-25 shows an alternative embodiment for a blade holder tool, namely a blade holder tool 210 with a pivoting action to open and close on a skate blade 152. Generally, the blade holder tool 210 includes features corresponding to features of the blade holder tool 170, such as a blade-engaging portion, unit-engaging portion, upper portion held by a user when placing the blade holder tool 210 into position, etc.

Figure 22:
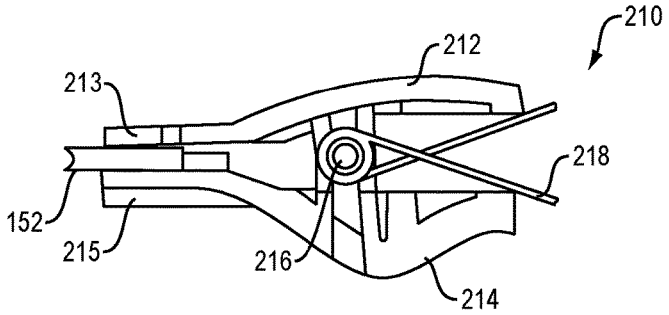
Figure 23:
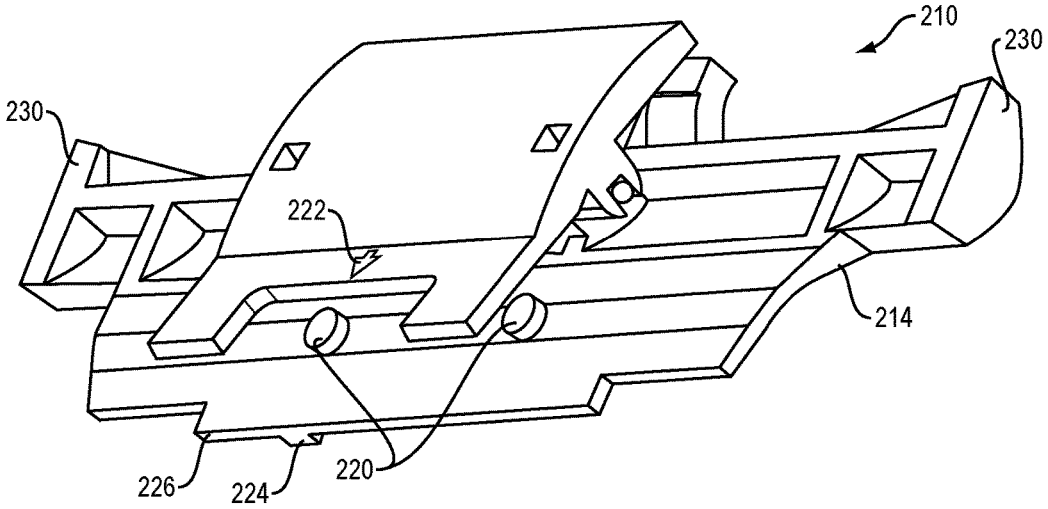

As is particularly visible in FIG. 22, the blade holder tool 210 includes two clamp halves 212, 214 connected by a pivot pin 216. A torsion spring 218 wraps around the pivot pin 216 and engages upper parts of the clamp halves 212, 214 to bias their lower, blade-engaging parts 213, 215 together, i.e., to a "closed" position. A user squeezes the upper parts together against this bias to open the blade holder tool 210 to insert a skate blade 152, then releases the upper parts to allow the blade holder tool 210 to close and grasp the skate blade 152. The blade-engaging parts 213, 215 grasp with a pinching force that may be in one of the ranges specified above for the flex beam configuration of blade holder tool 170. Here the forces in a particular embodiment are dictated not by ability of a user to generate sufficient push/pull force, but rather to generate sufficient squeezing force to open the clamp halves 212, 214 against the bias.

There are a few considerations in the design of the blade holder tool 210. First, the inner lower faces of the clamp halves 212, 214 are preferably angled slightly to come together parallel to one another when securing a blade of nominal thickness, which in one embodiment is approximately 0.11". This insures that these faces meet the skate blade 152 with maximum surface area, for a good grip, and with a small Y-direction width for fitting down into the clamping area of the sharpener unit 10.

Also, it may be preferable to use blade limit stops 220 that establish the relative Z-direction location of the skate blade 152 in the blade holder tool 210. This ensures that the correct amount of the skate blade 152 extends beyond the blade holder tool 210 to be captured by the jaws 90 and that the skate blade 152 will be otherwise properly loaded in the sharpener unit 10. The limits stops 220 also establish the Y-axis rotational position of the skate blade 152, providing the desired horizontal orientation of its bottom edge in the sharpening position.

The blade holder tool 210 may have a formed or printed centering arrow 222 to aid a user in aligning the center of the skate blade 152 with the center of the blade holder tool 210. Some skate blades 152 have corresponding centering marks on them, so a user can achieve centering by aligning the arrow 222 with the marks. In this case it may be beneficial for the clamp halves 212, 214 to be made from a transparent material such as polycarbonate. This would allow the user to easily see the skate blade 152 and the centering arrow 222 even after the blade 152 is secured into the skate clamp of the sharpener unit 10. It should be noted that a similar centering arrow (not numbered) is included in the above-described embodiments of FIGS. 11-14 and 18-19.

Instead of or in addition to the visual centering features such as arrow 222, it may be desirable to include mechanical keying features to help ensure exact centering and/or heel/toe orientation, as described above for the embodiments of FIGS. 11-14 and 18-19.

Figure 24:
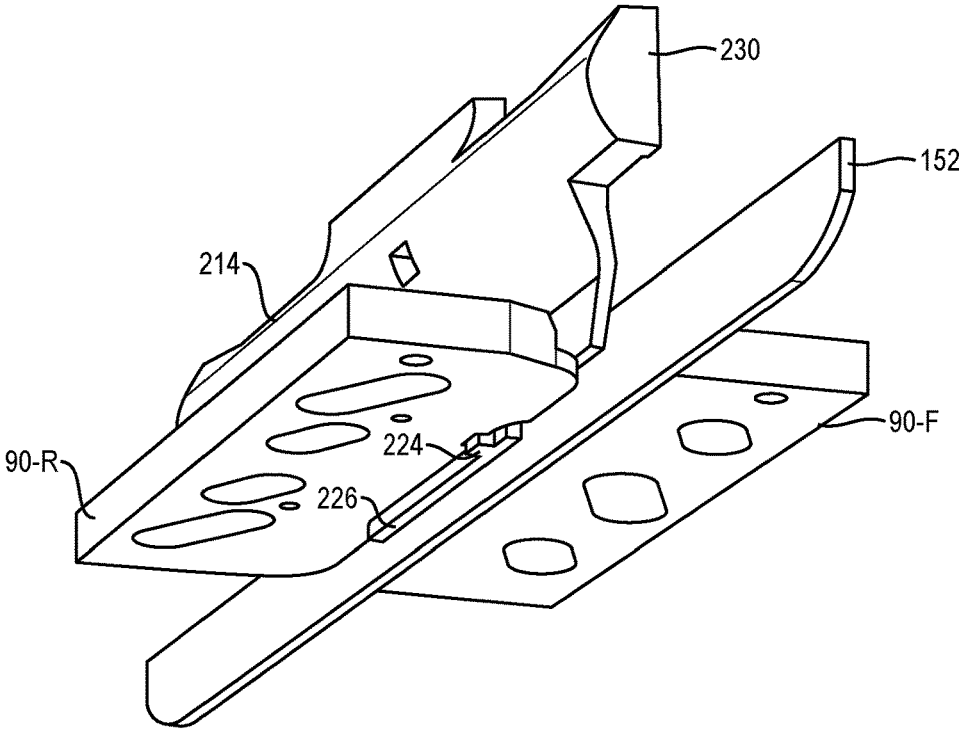
FIG. 24 is a bottom-up view of a skate blade with attached blade holder tool retained by clamp jaws.
Figure 25:
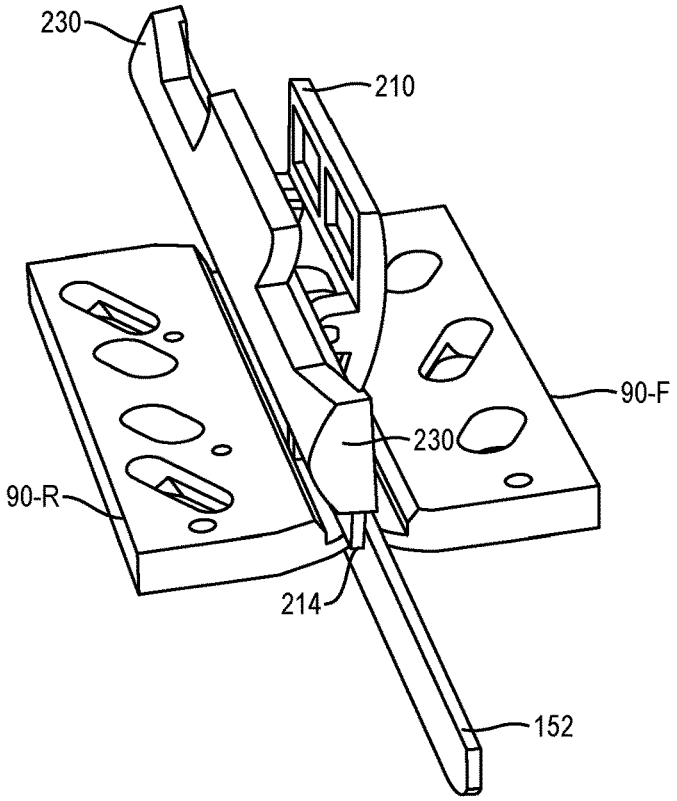
FIG. 25 is a top-down view of a skate blade with attached blade holder tool retained by clamp jaws.

FIGS. 24-25 illustrate another alignment feature, namely a bump-out 224 from an extension 226 at the bottom of the rear clamp half 214. As shown in FIG. 24 in particular, the bump-out 224 is a unit-engaging feature that fits within a cutout of the rear jaw 90-R of the sharpener unit 10. This co-configuring provides for proper heel/toe orientation of the blade 152 by requiring a corresponding orientation of the blade holder tool 210, i.e. with the clamp half 214 facing rearward rather than frontward. Note that this is a different way to orient heel/toe then described above for the embodiment of FIGS. 15-17. A key could be used instead of feature 184 in that embodiment, and vice versa—a feature 184 could be used in the embodiment of FIGS. 24-25 instead of a key.

The extension 226 serves to set the proper Z-direction location of the skate blade 152 by establishing a corresponding location of the blade holder tool 210. In particular, the blade holder tool 210 is moved downward to a position in which shoulder portions of the extension 226 rest on the top of the rear jaw 90-R. The blade holder tool 210 is designed so that when the shoulder portions are against the top of the jaw 90-R, the skate blade 152 has a Z-direction location that provides for solid clamping by the jaws 90 and for its lower edge to extend sufficiently below the jaws 90 to be encountered by the grinding wheel during operation.

Another feature of the blade holder tool 210 is a set of endward extensions 230 that partially mimic the blade holder portion 154 of a complete skate, contacting the bumpers 29 of the slot covers 28 when the blade holder tool 210 is holding a clamped blade 152 as depicted in FIGS. 24 and 25. This contact trips or actuates the limit switches 138 of the slot covers 28. The extensions 230 also block the open area of the slot 24 around the loose skate blade 152 and the jaws 90 to make sure a user's fingers cannot touch moving parts.

Beyond the above embodiments that employ a flex beam and spring-loaded pivoting members for retaining the skate blade 152, in alternative embodiments a blade holder tool may employ other types of retention mechanisms. One alternative is the use of a set screw or similar fastener that is tightened against one surface of the blade 152, pressing the blade against another surface of the blade holder tool to hold the blade 152 in place. In another alternative, a magnet may be incorporated into the blade holder tool to generate a magnetic retention force on the steel blade. In all cases, some or all of the above features that address the issues and goals can be included.

Figure 26:
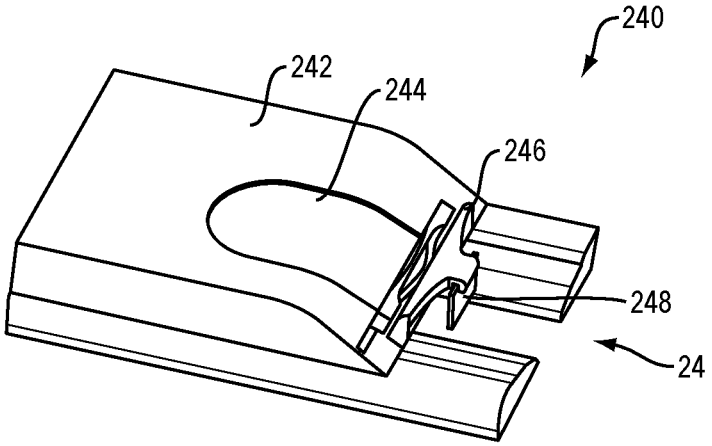
FIGS. 26-28 are views of slot covers for use on a sharpener unit.
Figure 27:
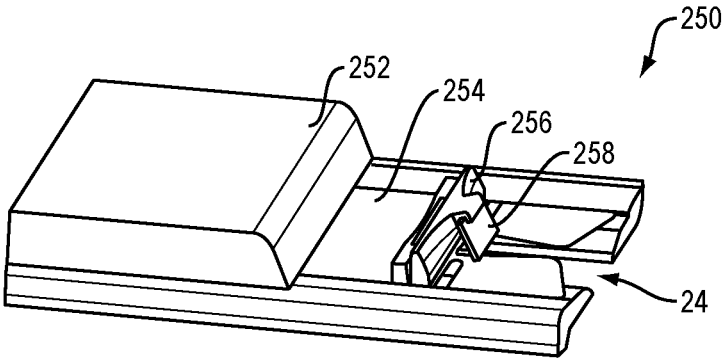
Figure 28:
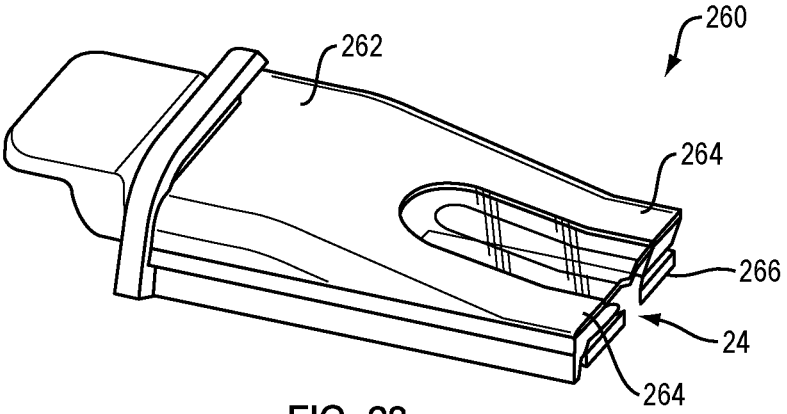
Figure 29:
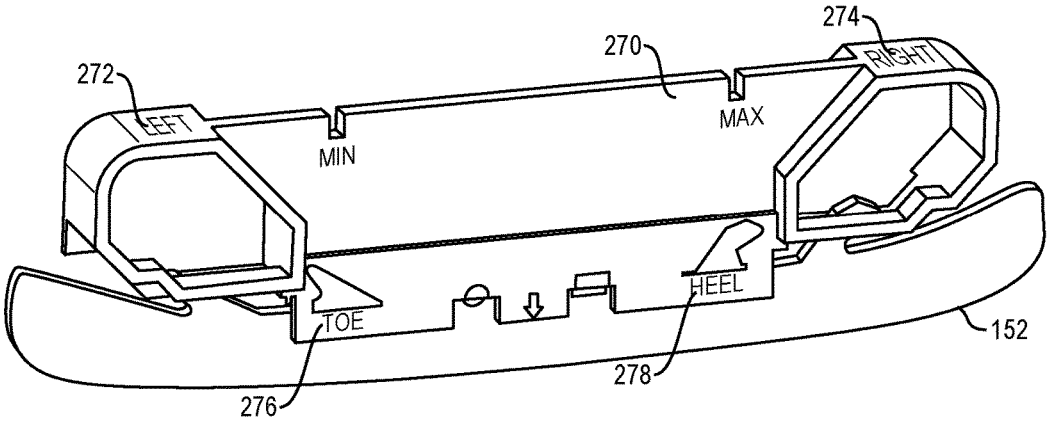
FIGS. 29-33 are views of a blade holder tool according to an alternative embodiment.
Figure 30:
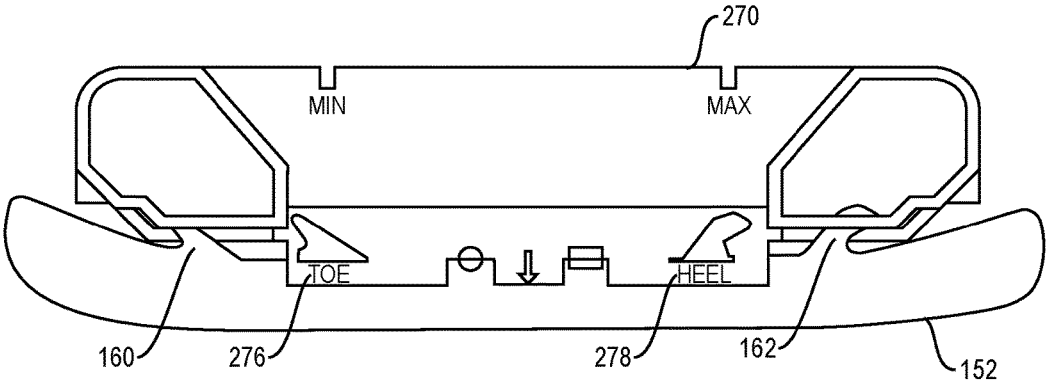
Figure 31:
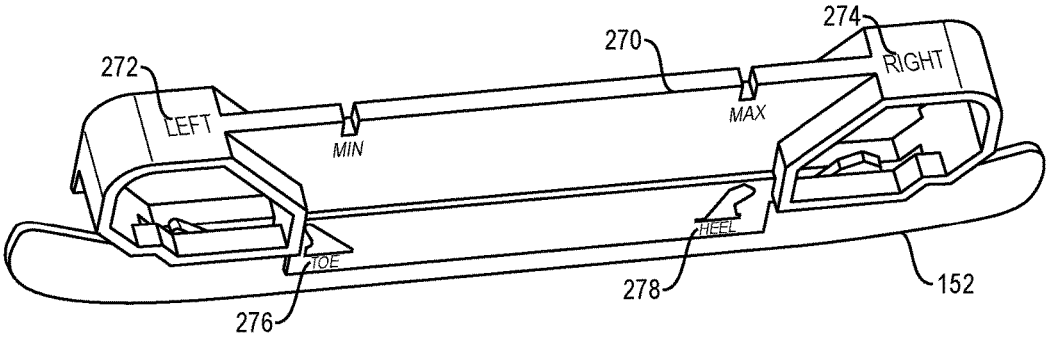
Figure 32:
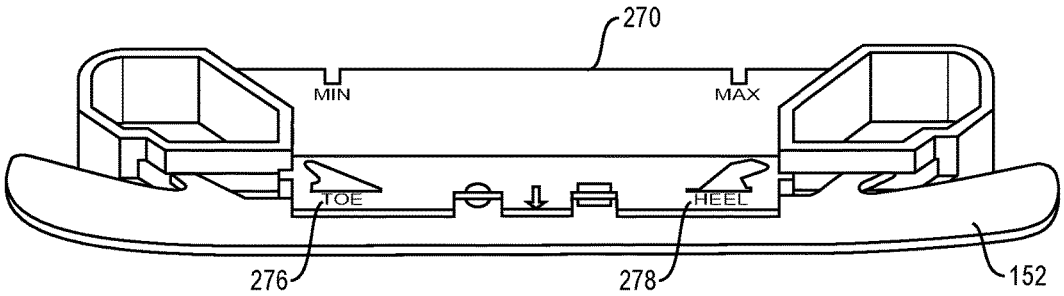
Figure 33:
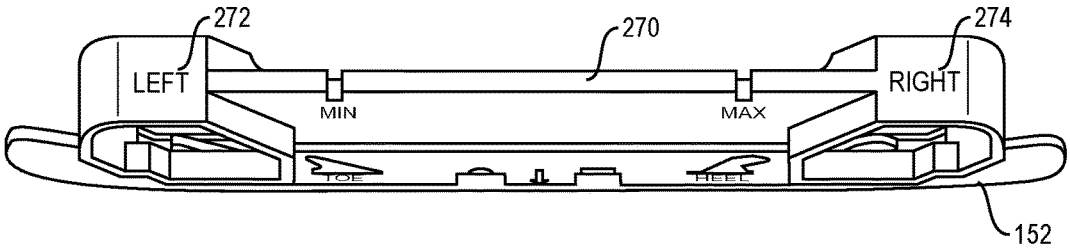
Figure 34:
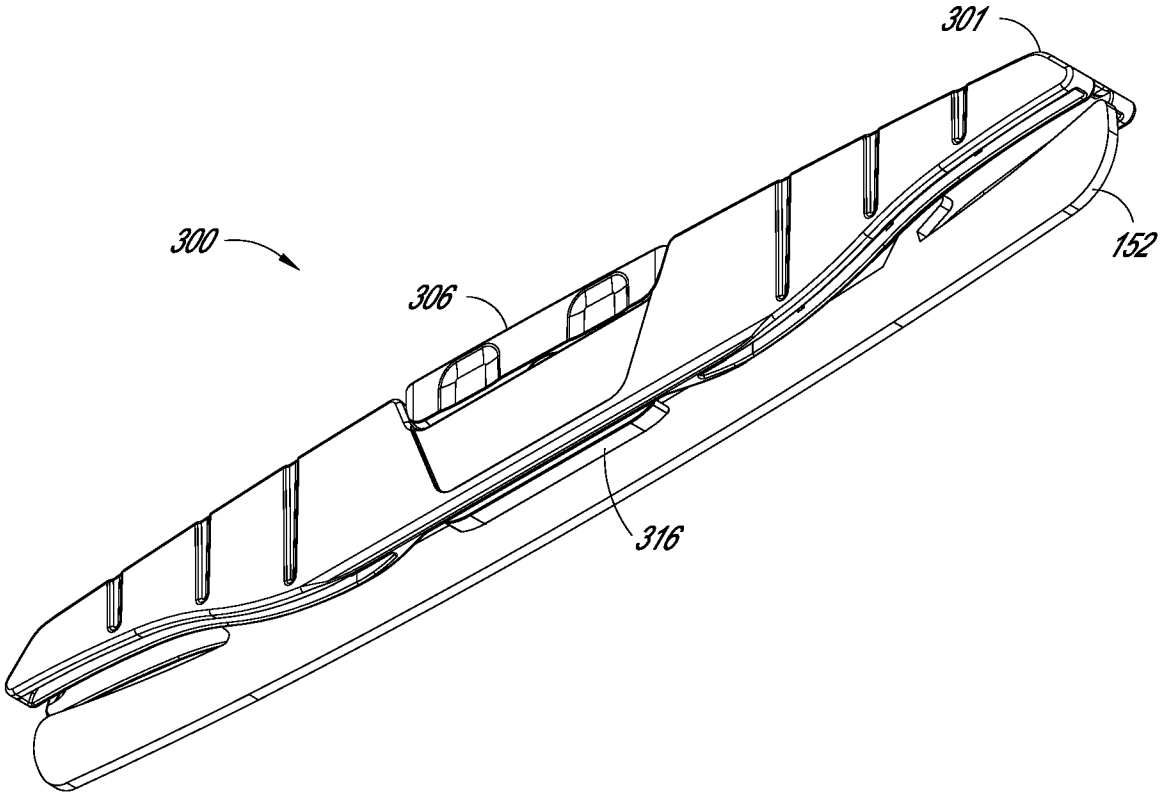
FIG. 34 is a perspective view of another embodiment of a blade holder tool.

FIGS. 26-28 illustrate alternative embodiments for the slot covers 28. Broadly, the slot 24 is an opening that creates the possibility of undesired contact with the grinding wheel inside the sharpener 10, and the slot covers 28 are protective covers that cover part of this opening to help prevent such undesired contact. In one embodiment, the slot 24 has an aspect ratio (ratio of length to width) of about 11:1. In an alternative embodiment, a slot having a different aspect ratio may be used. As a practical matter, the aspect ratio is greater than 3:1.

FIG. 26 shows a slot cover 240 having a stationary body 242 and a flexible membrane 244 that can be retracted and extended in a manner analogous to a roll door. A slidable latch 246 is attached to the end of the membrane 244 and includes a contact switch 248. In use, a user slides the latch 246 to the respective end of the clamped skate or blade holder tool, dragging the membrane 244 along to cover the slot 24. The contact switch 248 is triggered by contact with the end of the skate or blade holder tool. When this has been done for both covers 240 at the respective ends of the skate or blade, grinding operation is enabled.

FIG. 27 shows a slot cover 250 similar to the slot cover 240. In this case the membrane 254 extends from the bottom of the stationary body 252.

FIG. 28 shows a slot cover 260 having a stationary body 262 with extended leg portions 264 and a U-shaped opening. A stationary flexible membrane 266 covers a respective area of the slot 24, providing an air seal to retain dust and debris within the sharpener unit 10 during sharpening operation. The membrane 266 is split lengthwise into halves that part when a skate blade 152 is being inserted into or removed from the sharpener unit 10. An additional feature contemplated for the slot cover 260 is the inclusion of an electrical sensing circuit that detects the presence of a human finger or other conductive object when such a conductive object comes into contact with the surface of the slot cover 260. The output of this sensor can also be used to enable or disable operation, helping protect against the possibility of an object coming into contact with moving parts (e.g., the grinding wheel) of the system.

As an alternative to mechanical limit or contact switches as described above, in alternative embodiments there may be different types of sensing mechanisms such as optical, electrical or magnetic. In the case of optical sensing, a configuration similar to that of FIG. 28 may be used, with an optical emitter on one leg 264 and an optical sensor on the other leg 264. When the slot cover is in proper position, an opaque part of either a complete skate (blade holder portion 154) or a blade holder tool interrupts the optical path, which can be sensed to enable sharpening operation.

FIGS. 29-33 show a further alternative embodiment of a blade holder tool 270, which is generally similar to the blade holder tool 170 described above but incorporates graphical indicators for orienting the skate blade 152 in the blade holder tool 270 and for orienting the blade holder tool 270 in the sharpener unit 10. In the illustrated embodiment the graphical indicators are included along with the cutouts 195, 197 and related features as described above, but in general the graphical indicators may be used independently. In particular, the graphical indicators may make it unnecessary to include any separate features or indicators for blade orientation in the tool 270.

The tool 270 has labels 272, 274 indicating LEFT and RIGHT respectively and located at the left and right ends respectively of the tool 270. These labels indicate the correct orientation of the tool 270 with respect to the sharpener unit 10 as viewed in FIG. 1. A user orients the tool 270 with the LEFT label 272 at the left and the RIGHT label 274 at the right when inserting the tool 270 with attached blade 152 into the sharpener unit 10.

The blade holder tool 270 also includes respective labels 276, 278 with text and graphical indicators for assisting with correct orientation of the skate blade 152 in the tool 270. The label 276 includes the word TOE and a graphic of the protrusion 160 (FIG. 7) which should be inserted at this end. The right label 278 includes the word HEEL and a graphic of the protrusion 162 which should be inserted at this end.

Blade Holder Tool

FIGS. 34-40 illustrate an embodiment of a blade holder tool 300. The blade holder tool 300 includes a body portion 301 and a blade securing mechanism 306. The body portion 301 can be configured to house the blade securing mechanism 306. The blade securing mechanism 306 can be configured to secure a loose skate blade 152 within the blade holder tool 300. The blade securing mechanism 306 can be configured to secure a top central portion of the skate blade 152 within a blade engagement channel 312. The bottom portion and the blade edge are exposed to be positioned within the skate sharpener 10. The blade engagement channel or recess can be formed in at least one of a lower surface or a side surface of the body portion 301.

As will be known by those skilled in the art, "loose" blades can refer to skate blades that can be removed from the holder portion, such as holder portion 154, of an ice skate, such as ice skate 150. The loose blades can be fixed in position within the holder 154 and can be removed using from various means, mechanisms, or configurations. For example the holder portion may include a tool less retention mechanism, such as button 156, to secure the skate blade 152, the holder portion may include a retention mechanism that requires tools to remove, or other retention mechanism that allows skate blades to be releasably secured within the blade holder of the ice skate.

Figure 35:
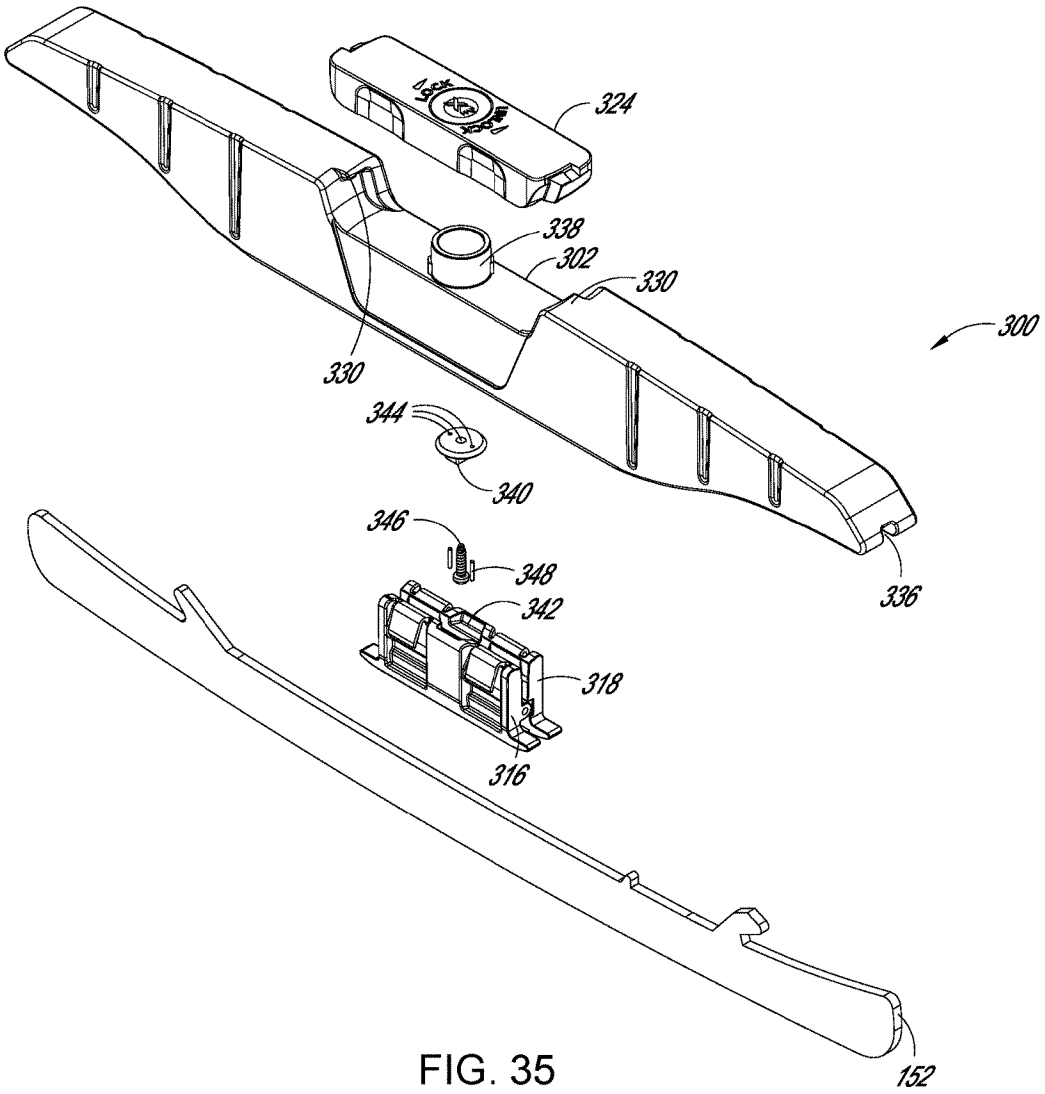
FIG. 35 is an exploded view of the blade holder tool.
Figure 36:
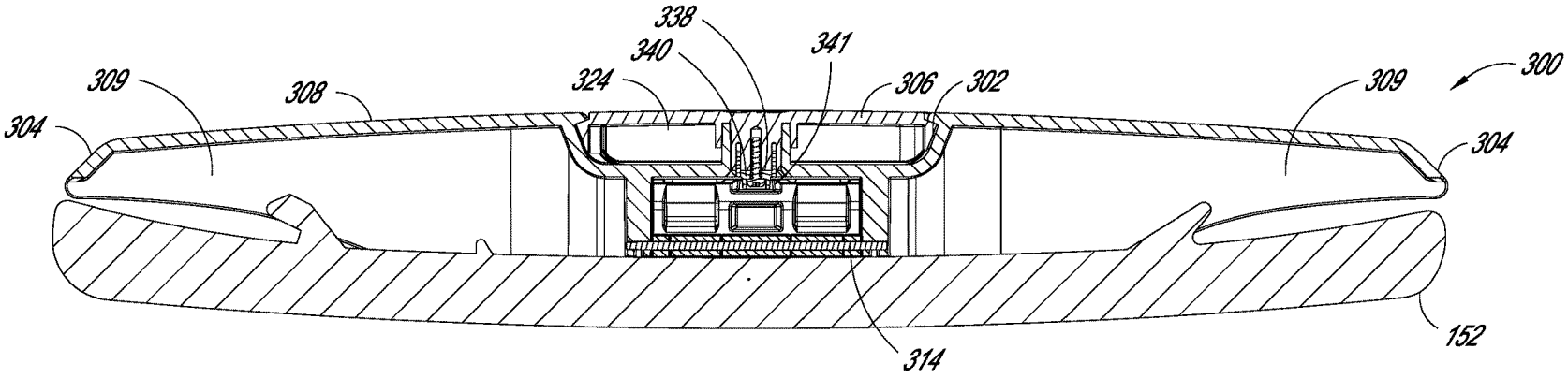
FIG. 36 is a side view illustrating a cross-sectional view of the blade holder tool.
Figure 37:
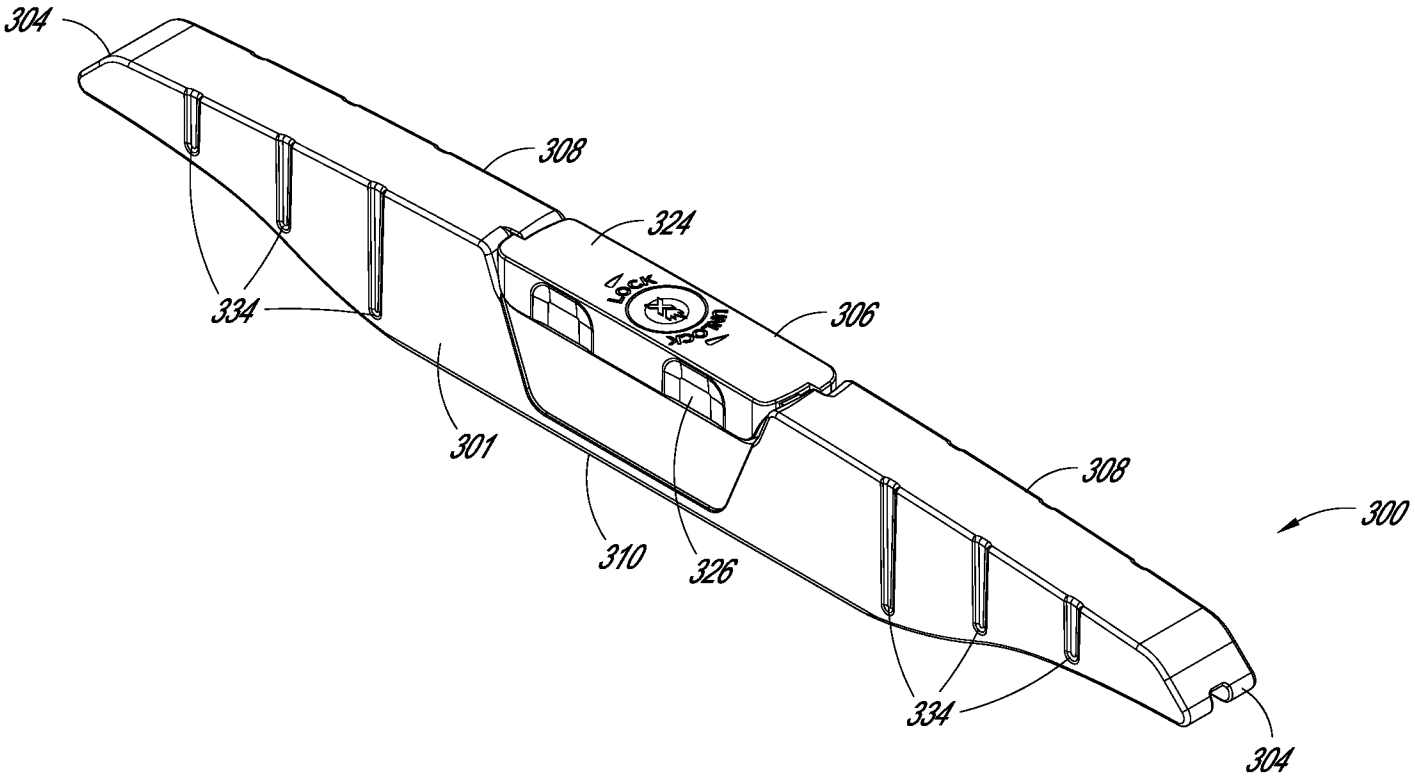
FIG. 37 is a perspective view of the blade holder tool.
Figure 38:
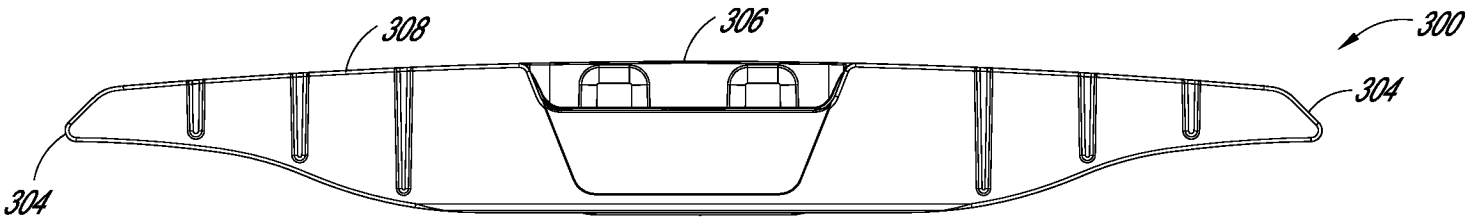
FIG. 38 is a side view of the blade holder tool.
Figure 39:
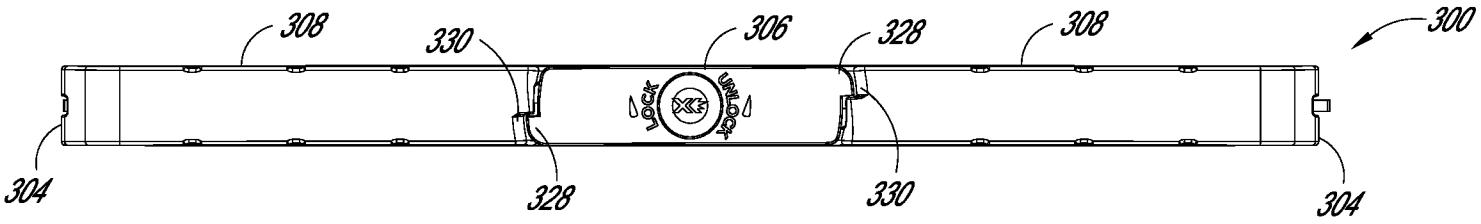
FIG. 39 is a top view of the blade holder tool

With specific reference to FIGS. 35 and 36, an exploded view and a cross section of an assembled view of the components of the blade holder tool 300 are illustrated. In the illustrated embodiment, the body portion 301 can include a central portion 302, intermediate portions 308, and/or endward portions 304. The blade securing mechanism 306 may include a handle 324, a cam 340, a fastener 346, mounting pins 348, and blade engagement members 316, 318.

The central portion 302 can generally house the components of the blade securing mechanism 306. The central portion 302 can include an opening 338. The opening 338 can extend outward from the central portion. The opening 338 can extend through the central portion 302. In some configurations, the opening 338 can be cylindrical. The central portion 302 can be sized and shaped such that the handle 324 can engage the cylindrical opening 338. The central portion 302 may include one or more handle stops 330. The handle stops 330 can be protruding elements that are molded into the body of the central portion that can limit or otherwise stop the rotation of the handle 324. The handle stops 330 advantageously may reduce or eliminate the likelihood of the user turning the handle 324 too far and over-rotating or over-extending the blade securing mechanism 306. The handle stops 330 also may reduce or eliminate the likelihood of the user turning the handle 324 in the incorrect direction when moving between open and/or closed positions of the blade securing mechanism 306.

The handle 324 can be sized and configured to fit within the central portion 302 such that the outer walls of the handle 324 can be substantially flush with the outer walls of the intermediate portions 308 of the body portion 301 when in a closed or clamping position. The handle 324 may include protrusions disposed along one, two, three, and/or four or more sides of the handle 324 that engage with the handle stops 330. For example, the illustrated handle 324 includes protrusions 328 extending from an edge of each of two short and/or long sides of the handle 324 that engage the handle stops 330. The protrusions 328 may have one, two, and/or three or more flat sides and one, two, and/or more curved sides. The protrusions 328 may have one or more flat sides and one or more curved sides. In some embodiments, when the handle 324 is in the closed or clamping position, the protrusions 328 are configured to engage the handle stops 330 on the central portion 302.

In some embodiments, the handle 324 may comprise one, two, three, and/or four or more grips 326 along sides of the handle 324. The grips 326 advantageously may allow the user to turn the handle 324 more comfortably and grip the blade holder tool 300 more tightly. The grips 326 also advantageously may allow the user to better grasp the blade holder tool 300 when handling and/or grasping the tool 300 while placing the skate blade 152 in the sharpening position. The handle 324 also may comprise formed, imprinted, and/or other mechanical features or other indicia for indicating one or more directions to turn the handle 324 to open and/or close the handle 324. For example, the top portion of handle 324 may comprise arrows and/or other markings guiding the user to turn the handle 324 in a clockwise and/or counterclockwise direction.

In the illustrated embodiments, the blade securing mechanism 306 utilizes a rotational handle 324. The handle 324 can rotate about an axis generally parallel to the side surface of the tool body 301. However, in other embodiments, the blade securing mechanism 306 may comprise any number of adjustment and/or rotational adjustment mechanisms. For example, in some arrangements, the adjustment mechanism used to open and/or close the blade securing mechanism 306 may include a knob mechanism that can be rotated, a slider mechanism that can use translational movement, a push button mechanism that can release and lock the blade securing mechanism 306, and/or a screw-based mechanism, among other adjustment mechanisms.

The cam 340 and blade engagement members 316, 318 can be engaged or coupled to the handle 324 through the opening 338. The opening 338 may be a cylindrical opening, and the handle 324 may rotate about the axis. The cam 340 may include one or more attachment orifices 344 configured to receive fastening mechanisms for securing the cam 340 to the handle 324. The orifices 344 may have a threaded and/or smooth interior. In the illustrated embodiment, the cam 340 is coupled to the handle 324 by a threaded fastener 346 and locking pins 348. In other embodiments, the cam 340 may be secured using different means, mechanisms, or configurations. The cam 340 may be double-sided and/or single-sided. The lobes of the cam 340 may have various shape profiles. For example, the lobes of the cam may be rectangular, ovular, trapezoidal, ellipsoidal, and/or other shapes. The cam 340 can be configured to be positioned within a cavity 341. The cavity 341 can be formed by walls 342 of the blade engagement members 316, 318.

Figure 40:
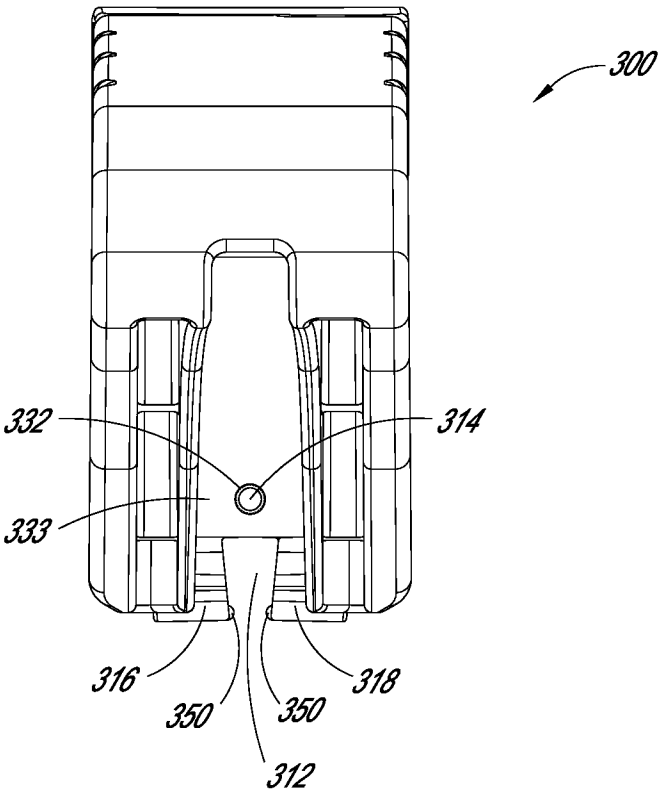
FIG. 40 is an on-edge side view of a blade holder tool

The blade engagement members 316, 318 can be coupled to the body portion 301 using a pivot pin 314. The blade engagement members 316, 318 can pivot about the pivot pin 314. As illustrated in FIG. 40, the body portion 301 may include a pivot pin slot 332 configured to receive the pivot pin 314. In some embodiments, the blade engagement members 316, 318 may be at least partially held in place within the locking mechanism by the locking screw 346. In other arrangements, the blade engagement members 316, 318 may be at least partially held in place within the blade securing mechanism 306 by inner walls of the body portion 301.

When assembled, the body portion 301 and the blade securing mechanism 306 form a blade engagement channel 312 that can accommodate a skate blade 152. The blade engagement channel 312 can have a defined width and height. The width of the blade engagement channel 312 can be defined by the separation of the blade engagement members 316, 318. The height of the blade engagement channel 312 can be defined by one or more vertical positioning features or vertical stops, such as, for example, endwalls 333, blade engagement members 316, 318, and/or by another feature on the blade holder tool. The vertical positioning feature of the blade engagement channel can be configured such that the top edge of the skate blade 152 abuts the vertical positioning feature(s) when inserted within the blade engagement channel 312 at a defined vertical position. In some embodiments, the endwalls 333 can be configured to extend a defined length into the channel such that the top edge skate blade abuts the endwalls 333. In some embodiments, one or more vertical positioning surfaces formed by at least one of the blade engagement members 316, 318 are configured to abut the top edge of the skate blade. In some embodiments, the vertical positioning feature can be one or more walls or protrusions that are positioned within the intermediate portions or endward portions. In some embodiments, the endwalls 333 and the one or more vertical positioning surface(s) of the blade engagement members are positioned at substantially the same height.

The handle 324 can rotate between a locked, clamping, or "closed" position and an unlocked or "open" position. In the "open" position, a skate blade can be positioned within the blade engagement channel 312. The open position may include any position in which the locking mechanism is not completely locked. For example, the opened position can include any degree of rotation of the handle 324, including 5°, 10°, 15°, 20°, 25°, 30°, 35°, 40°, 45°, 50°, 55°, 60°, 65°, 70°, 75°, 80°, 85°, and/or 90°, among other degrees. Once the skate blade 152 is positioned within the blade engagement channel 312 of the blade holder tool 300, a user may twist or turn the handle 324 to engage or disengage the blade securing mechanism 306. In other embodiments, other mechanisms can be used to engage or disengage the blade securing mechanism, such as, for example, a knob mechanism that can be rotated, a slider mechanism that can use translational movement, a push button mechanism, and/or a screw-based mechanism, among other adjustment mechanisms that can engage and disengage the blade engagement members 316, 318. Manipulating (e.g., twisting, rotating, and/or turning) the handle 324 can result in each of the blade engagement members 316, 318 moving towards each other to engage a lateral portion of the skate blade 152. In some embodiments, only one of the blade engagement members 316, 318 moves towards the other, while the non-moving blade engagement member is fixed. When the blade holder tool 300 is in the closed position, the skate blade 152 is retained in place by lateral forces applied by at least one of the blade engagement members 316, 318 on the side surfaces of the skate blade 152.

In some embodiments, the blade engagement members 316, 318 of the blade securing mechanism 306 can include engagement feet 350. The engagement feet 350 can help to accommodate different thickness skate blades while maintaining sufficient force to properly position the skate blade 152 within the blade engagement channel 312. In some embodiments, the engagement feet 350 can be configured with a rounded or contoured surface in order to provide an engagement force that is substantially normal to the side or lateral surface of the skate blade 152 (e.g., surfaces that are normal to the ice-contacting end surface of the skate blade).

The specific configuration of the engagement feet 350 can affect the amount of force used to secure the skate blade 152 within the blade holder tool 300. The size (e.g. length width, thickness, etc.), shape (e.g., rectangular, circular, hemispherical, etc.), material (e.g., compressible or noncompressible), number of feet on each blade engagement member (e.g., 1, 2, 3 or more feet), and the like, can vary dependent upon the design of the feet. For example, in the illustrated embodiment, the blade engagement feet 350 are positioned on both blade engagement members 316, 318 and are relatively thin protrusions that extend substantially the width of the blade engagement members 316, 318. In other embodiments, there may be a plurality of hemispherical protrusions on only one of the blade engagement members for example but without limitation. The feet may be formed out of the same material as the blade engagement members. In some embodiments, the engagement feet 350 may be formed out of a different material than the blade engagement feet, such as a compressible material (e.g., rubber). The specific configuration and material of the engagement feet 350 can affect the minimum amount of force used to secure the skate blade 152 within the blade holder tool 300.

In some embodiments, the feet 350 can be configured to interface with cutouts on a skate blade, such as the cutouts 203, 205 in the blade 152A. The feet 350 may be sized and shaped to match specific brands of skate blades. In such embodiments, the blade holder tool may not be compatible with all types of skates. For example, a blade holder tool manufactured for one brand of skate blade may be incompatible or have a poor fit when used with other brands of skate blades and would not interface properly with the skate sharpener 10.

The blade engagement members 316, 318 and/or the feet 350 can be configured rotationally position the skate blade (rotation about the X axis). The blade engagement members 316, 318 can be configured to position the skate blade so that it is substantially vertical when positioned within the skate blade holder. The blade engagement mechanism can be configured so that when in the closed position, the skate blade in positioned in the correct rotational orientation. For example, the blade engagement members 316, 318 and/or the feet 350 can position the skate blade 152 so that it is substantially vertical (e.g., aligned parallel to the Z axis), such as, for example, less than or equal to 5 degrees from vertical, or within 10 degrees from vertical. In some embodiments, one blade engagement member is configured to be fixed in a substantially vertical orientation. In such an embodiment, the skate blade can be positioned against the fixed blade engagement member in a substantially vertical orientation and a second blade engagement member can secure the skate blade in position by applying a lateral force to the side of skate blade.

FIG. 40 provides an end view illustrating the clamp-like configuration of the blade-engagement members 316, 318 and the blade engagement channel 312. When the blade holder tool 300 is in the open position, the blade engagement members 316, 318 are spaced apart by a defined distance and provide for a skate blade 152 to be positioned within the blade engagement channel 312. The blade holder tool 300 can be configured to hold the skate blades 152 of the same and/or different lengths and widths. For example, the same blade holder tool 300 may be configured to hold adult skate blades as well as a much shorter blade 152, as might be used by a child skater. In some embodiments, the blade holder tool can be configured to accommodate skate blades of different lengths using a standard size blade holder. The blade holder may have cavities 309, such as illustrated in FIG. 36, within the intermediate portion that can accommodate various lengths, shapes, skate engagement elements, and the like. In some embodiments, skate blades of different lengths can use different blade holders, such as blade specific blade holder tools 300 for the different types of skates (e.g., a first type for hockey player skates, another for goalie skates, and/or another for figure skates, among others).

The blade holder tool 300 can be configured to secure skate blades 152 of varying thicknesses. For a thinner blade, there may be a lower retention and/or clamping force than for a thicker blade 152. However, the blade holder tool 300 can be configured to provide sufficient force to secure the skate blades of varying thicknesses within the channel 312. In general, the blade holder tool 300 can be configured to accommodate a range of blade thicknesses. For example, in some embodiments, the blade holder tool 300 can be configured to secure skate blades having thicknesses between 0.080 inch and 0.200 inch and more preferably between 0.100 inch and 0.125 inch. The blade holder tool can be configured to accommodate blade thicknesses of greater or smaller thicknesses as well. Example embodiments of skate blade thicknesses are discussed in further detail above.

The blade holder tool 300 may include one or more physical and/or visual alignment features. In some embodiments, the blade holder tool 300 includes alignment/orientation features including a blade centering (X-axis location) feature, a blade vertical positioning (Z-axis location) feature, a blade rotational positioning (angle about Y axis) feature, and/or a heel/toe orientation feature. The blade rotational features can ensure that the bottom edge of the skate blade 152 is substantially horizontal in the sharpening position, so that the grinding wheel contacts the bottom edge along its length with a desired amount of normal force (see FIG. 3). As described above, the blade engagement members 316, 318 and/or the feet 350 can be configured rotationally position (about the X axis and/or Y axis) the skate blade within the blade holder tool.

The vertical position of the blade 152 can be based on the depth of the channel. As described above, depth of the blade engagement channel 312 can be defined by one or more vertical positioning features, such as, for example, endwalls 333, blade engagement members 316, 318, and/or by another feature on the blade holder tool. The vertical positioning feature of the blade engagement channel can be configured such that the top edge of the skate blade 152 abuts the vertical positioning feature(s) at a defined vertical position when inserted within the blade engagement channel 312. Furthermore, the vertical positioning feature(s) can be configured to ensure that the top edge of the skate blade 152 has the correct horizontal orientation so that the grinding wheel contacts the bottom edge along its length with a desired amount of normal force.

In some embodiments, the central portions 302, the intermediate portions 308, and/or the endward portions 304 can include alignment features, such as, vertical markings, indentations, or cutouts. In some embodiments, such alignment features may be positioned on the intermediate portions 334. The alignment features may be spaced at equal and/or varied distances along the intermediate portions 334. The alignment features 334 may have varying lengths and depths. For example, the alignment features 334 can help the user generally center the skate blade 152 within the blade holder tool 300. Advantageously, the user may not be required to perfectly align the skate blade within the blade holder tool because the skate sharpener 10 can be configured to automatically align the blade 152 when the blade 152 is being positioned for a sharpening operation.

In the illustrated embodiment, the blade securing mechanism 306 is positioned substantially in the center of the blade holder tool 300. In some embodiments, the blade holder tool does not have a plurality of blade engagement mechanisms positioned on the ends (e.g., blade engagement portions at opposite ends of the blade holder tool). In the illustrated embodiment, the blade securing mechanism includes a single centrally located clamping mechanism for securing the skate blade. In some embodiments, the blade securing mechanism can apply a force to a lateral side of a substantially central portion of the skate blade to secure the skate blade within the blade holder tool. In some embodiments, the blade engagement members of the blade engagement mechanism can extend a portion of the length of the entire body, such as, for example, less than 20% of the length of the body, less than 30% of the length of the body, less than 40% of the length of the body, less than 50% of the length of the body, between 10% and 50%, between 20% and 30%, between 20% and 40%, or combination of the above ranges.

Figure 41C:
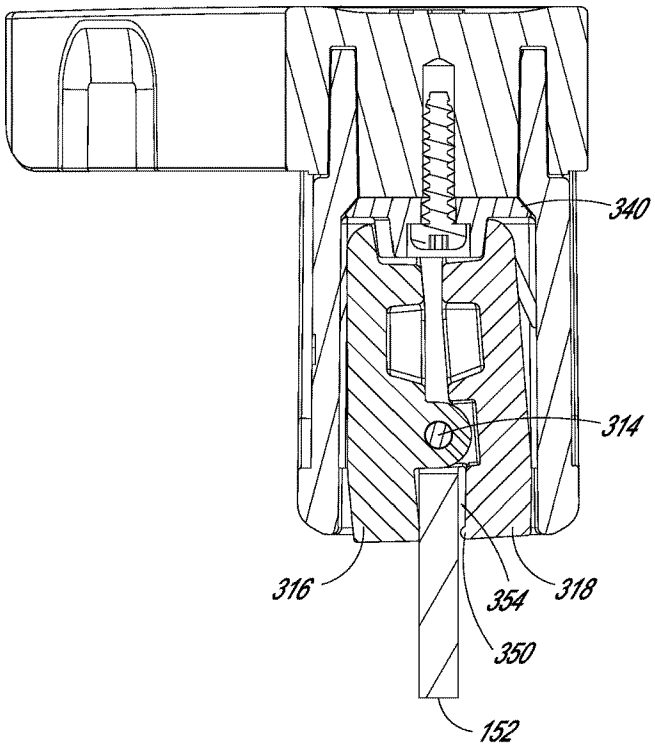
FIG. 41A-41C is a side view illustrating a cross-sectional view of embodiments of a blade holder tool.
Figure 41B:
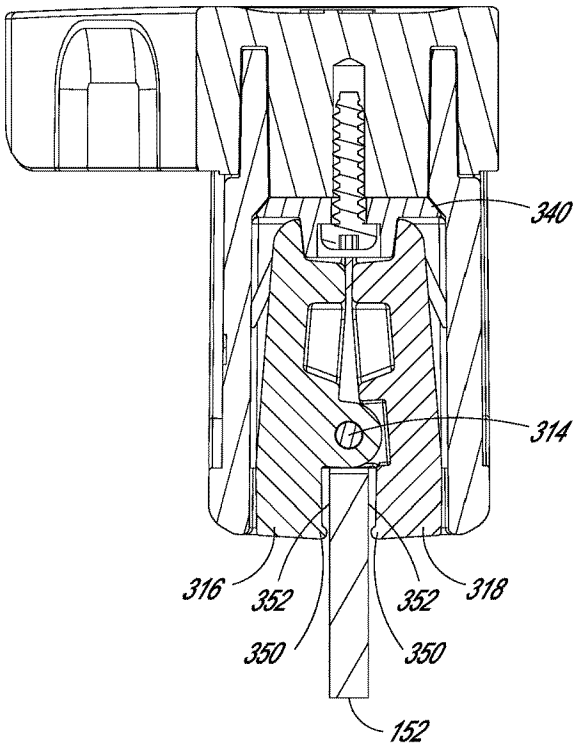
Figure 41A:
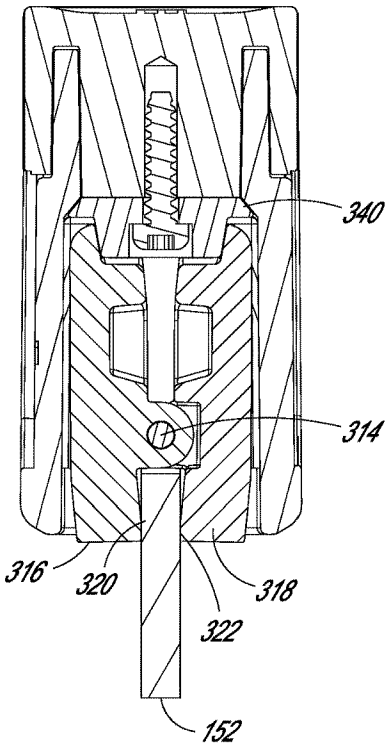

FIGS. 41A-41C illustrate cross sections of the blade holder tool 300 with a skate blade 152 positioned within the blade engagement channel 312. The blade-engaging portion 312 can include a cam mechanism and/or interference fit configuration to grip the skate blade 152. FIG. 41A illustrates an embodiment of the blade securing mechanism in a closed position. FIGS. 41B and 41C illustrate embodiments of blade securing mechanisms in open positions. In the open position, the user can insert the desired skate blade 152 into the blade-engagement channel 312 and secure the skate blade into position by manipulating the handle 324.

As illustrated in FIG. 41A, when the handle 324 is rotated to the closed position, the cam 340 rotates, which causes the lobes of the cam to apply force to the walls 344 of the blade engagement members. The force causes the blade engagement members to pivot about the pivot pin 314 and apply force to at least one side of the skate blade 152. The blade engagement members can provide sufficient force to secure the skate blade 152 within the blade engagement tool. The force applied to the skate blades can be approximately 20 pounds, and is generally between 1 and 40 pounds. In some embodiments, the force applied by the blade engagement members can be 1-10 pounds, 10-20 pounds, 20-30 pounds, 30-40 pounds, or any force in between. As illustrated, no gap exists between the blade-engaging parts 320, 322 and the sides of the skate blade 152 when the handle is in the closed position. The shape and material of the blade engagement members can affect the force required to secure the skate blade within the blade engagement channel 312. For example, in some embodiments, the blade engagement members may be formed from a compressible or rubber-like material that may lower the force in comparison to if the blade engagement members were formed of a noncompressible material. In some embodiments, the blade engagement members may require a low clamping force but may be able to keep the skate blade 152 secured into position using other mechanics.

FIG. 41B illustrates an embodiment of the blade holder tool 300 that includes blade engagement members that are moving toward each other. In the illustrated embodiment, there is a gap 352 between the blade-engaging parts 316, 318 and the sides of the skate blade 152. The user can turn or twist the handle 324 to open the blade holder tool 300 to insert the skate blade 152. As the handle 324 is rotated, both blade engaging members 316, 318 move toward each other to apply a lateral force to the side of the skate blade 152. More specifically, as the handle 324 and cam 340 are rotated, the cam 340 exerts a force to the upper part of the blade engagement members 316, 318. To balance the locking force exerted by the cam 340 on the upper part of the blade engagement members 316, 318, an equal grasping force is exerted in an opposite direction on both sides of the skate blade 152 by the corresponding blade engagement members 316, 318 to secure the skate blade 152.

FIG. 41C illustrates an embodiment in which only one of the blade engagement members 316, 318 moves to engage the skate blade 152 when the handle 324 is rotated. As illustrated, a gap 354 exists only between one of the blade engagement members 318 and a corresponding side of the skate blade 152. In this embodiment, the blade engagement members 316 is fixed in position and the other of the blade engagement members 318 can pivot about pivot pin 314 to engage the skate blade 152. The cam 340 may have a single lobe that is configured to only apply force to the blade engagement member 318. As the handle 324 and the cam 340 are rotated, the cam 340 exerts a force to the upper part of one of the blade engagement member 318. To balance the locking force exerted by the cam on the upper part of the blade engagement member 318, an equal grasping force is exerted in an opposite direction on one side of the skate blade 152 by the corresponding blade engagement member 318 to secure the skate blade 152.

Figure 42A:
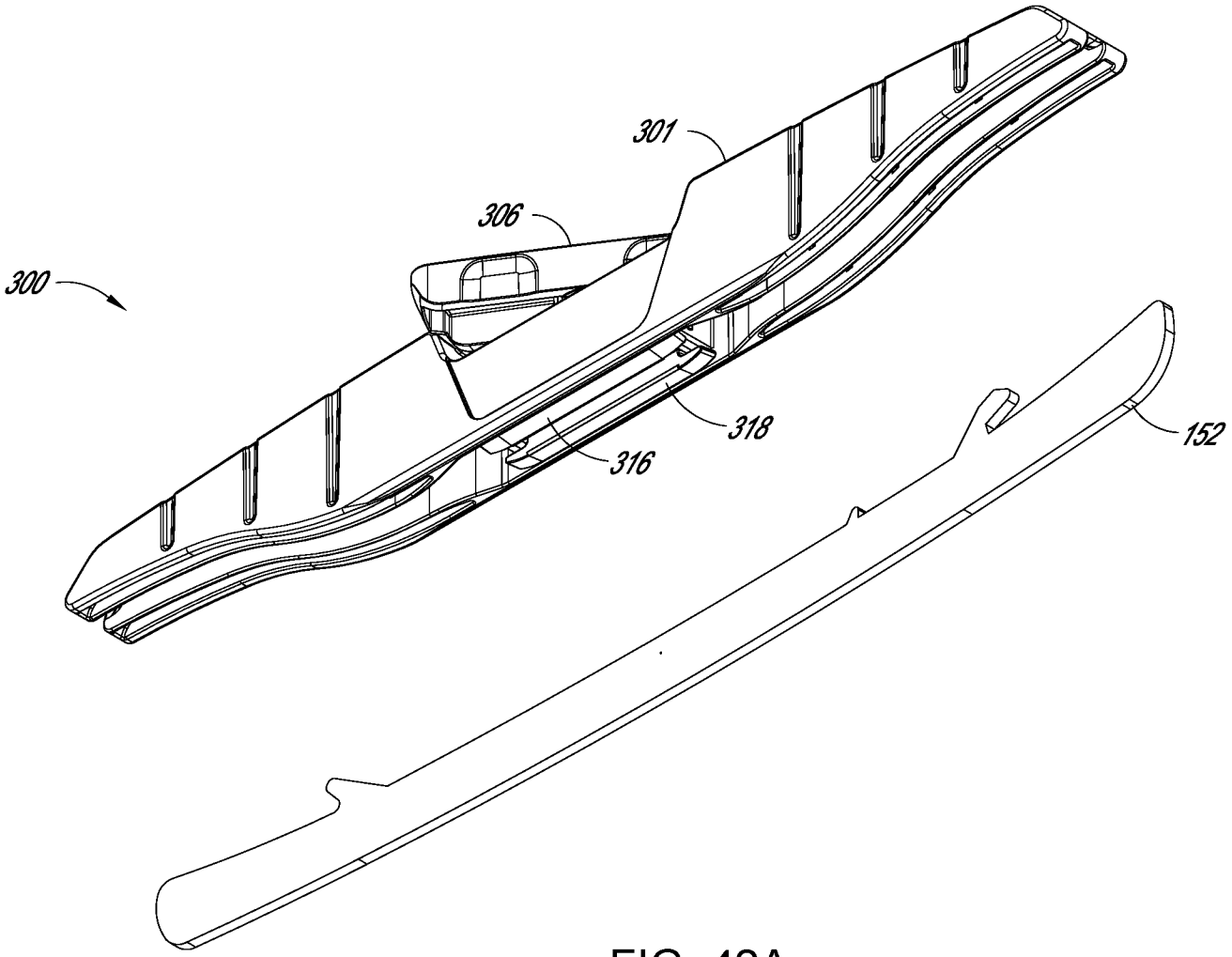
FIGS. 42A-42C illustrate a process for securing a loose skate blade within the blade holder tool.
Figure 42B:
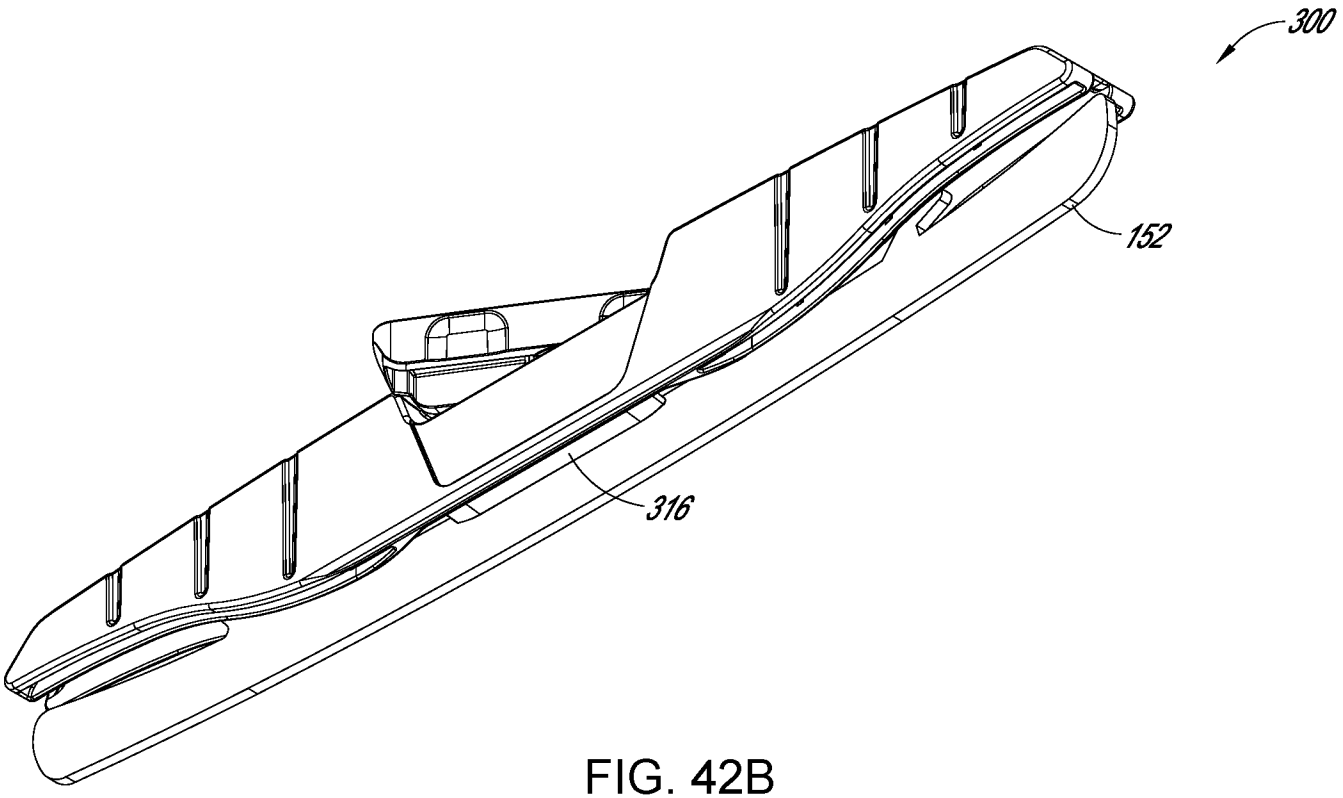
Figure 42C:
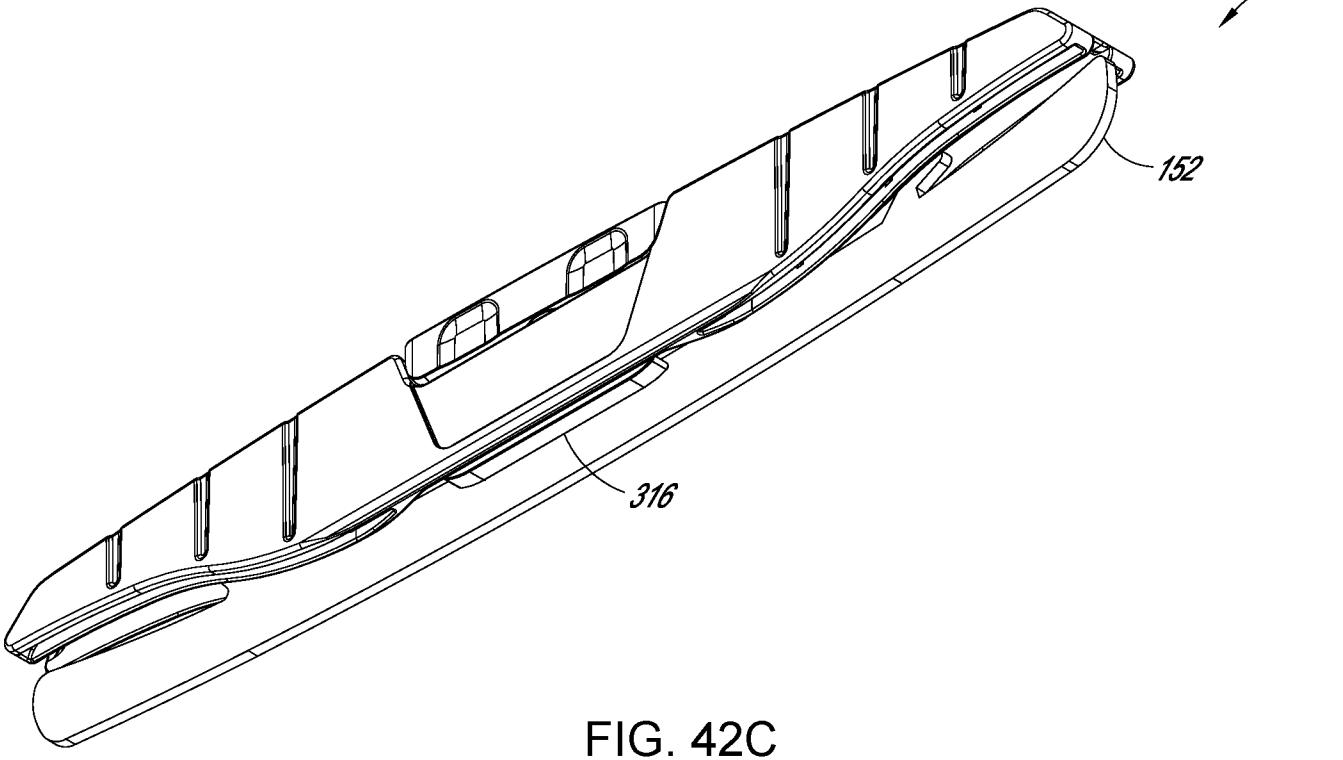

FIGS. 42A-42C illustrate a perspective view of the process for securing a loose skate blade 152 within the blade holder tool 300. In FIG. 42A, the handle 324 is positioned in the open position. The position of the handle 324 at least partially widens the spacing between the blade engagement members 316, 318 such that tool is capable of receiving blade 152. In FIG. 42B, the skate blade is positioned within the blade holder tool 300. The user can align the skate blade using the alignment features 334 to generally center the blade within the holder. The vertical alignment of the blade can be performed by verifying that the skate blade is fully inserted into the blade engagement channel 312 prior locking the blade into position. FIG. 42C shows the handle 324 in the closed position. In this embodiment, the closed position is aligned with a longitudinal axis of the tool 300. In the closed position, at least one of the blade engagement portions exerts sufficient force to secure the skate blade in position.

When the skate blade 152 is secured, the blade holder tool 300 can be used to position the skate blade 152 within the skate sharpener 10 for use during a sharpening operation. The skate sharpener 10 can secure the skate blade within the skate sharpener 10 using retention jaws 90, as described herein. When the blade holder tool 300 and the skate blade 152 are positioned on the skate sharpener 10, the endward portions 304 and/or the ends of the skate blade 152 may contact the bumpers 29 of the slot covers 28. The contact can trip or actuate the limit switches 138 of the slot covers 28 so that the skate sharpener can operate. The blade holder tool 300 can also block the open area of the slot 24 around the retention jaws 90 and skate blade 152 in order to reduce or eliminate the likelihood of the insertion of foreign objects (e.g., a user's fingers) into the skate sharpener 10 during a sharpening operation.

While various embodiments of the invention have been particularly shown and described, it will be understood by those skilled in the art that various changes in form and details may be made therein without departing from the spirit and scope of the invention as defined by the appended claims.

What is claimed:

1. A blade holder to hold single skate blades for sharpening, the blade holder comprising:

a first sidewall and a second sidewall, the first sidewall positioned opposite the second sidewall, a blade engagement channel formed between the first sidewall and the second sidewall;

a first blade-engaging member and a second blade-engaging member coupled to the blade holder and positioned within the blade engagement channel, wherein bottom surfaces of the first sidewall and the second sidewall define a bottom of the channel, wherein at least the first blade engaging member is configured to move toward the opposite sidewall of the first sidewall or the second sidewall; and a user-controlled component coupled to the blade holder, wherein manipulation of the user-controlled component between a first position and a second position is configured to control movement of at least the first blade-engaging member within the blade engagement channel;

wherein, in the first position, a gap between the first blade-engaging member and the second blade-engaging member allows the skate blade to be positioned between the first blade-engaging member and the second blade-engaging member; and wherein manipulation of the user-controlled component from the first position to the second position moves at least the first blade-engaging member to reduce the gap and laterally engage a respective side of the skate blade such that the first blade-engaging member and the second blade-engaging member hold the skate blade at a bottom portion of the blade engagement channel and a skating edge of the skate blade extends beyond the bottom surfaces of the first sidewall and the second sidewall.

2. The blade holder of claim 1, wherein the blade engagement channel has at least one vertical positioning feature defining a vertical stop within the blade engagement channel configured to position the skate blade at a defined height when engaged with the vertical positioning feature.

3. The blade holder of claim 2, wherein the at least one vertical positioning feature is configured to constrain rotation of the skate blade such that the skate blade is positioned in a substantially horizontal position when engaged with the at least one vertical positioning feature.

4. The blade holder of claim 1, wherein at least one of the first blade-engaging member or second blade-engaging member is configured to constrain lateral rotation of the skate blade such that the skate blade is positioned in a substantially vertical position when engaged with the first blade-engaging member and second blade-engaging member.

5. The blade holder of claim 1 further comprising a cam mechanism rotatably coupled to the blade holder, the cam comprising a lobe positioned on at least a portion of the cam, and, when rotated, the lobe is configured to move at least the first blade-engaging member to engage the skate blade.

6. The blade holder of claim 1, wherein at least the first blade-engaging member is configured to apply a lateral force to a side of the skate blade.

7. The blade holder of claim 6, wherein at least the first blade-engaging member is configured to apply the lateral force to a middle portion of the skate blade.

8. The blade holder of claim 1, wherein at least the first blade-engaging member extends less than or equal to 50% of the length of the blade holder.

9. The blade holder of claim 1, wherein the first blade engaging member is configured to move toward the second blade-engaging member and the second blade-engaging member is configured to move toward the first blade-engaging member such that the first blade-engaging member and second blade-engaging member engage the skate blade and hold the skate blade at the bottom portion of the blade holder tool.

10. The blade holder of claim 1, wherein the user-controlled component is a rotatable handle configured to control engagement of at least the first blade-engaging member based on the rotation of the handle.

11. The blade holder of claim 1, wherein the blade holder further comprises alignment features configured to help a user align the position of the skate blade within the blade holder.

12. The blade holder of claim 1, wherein the blade holder further comprises at least one endward portion, the endward portion configured to actuate a switch on a slot cover of a skate sharpener when the blade holder and the skate blade are correctly positioned within the skate sharpener for a sharpening operation.

13. The blade holder of claim 12, wherein actuation of the switch on the slot cover by the endward portion is required to enable the skate sharpener to perform a blade sharpening operation.

14. The blade holder of claim 1, wherein the blade holder is configured to prevent access to a blade receiving slot of a skate sharpener when the blade holder and the skate blade are correctly positioned within the skate sharpener for a sharpening operation.

15. The blade holder of claim 1, wherein the blade holder further comprises alignment markings identifying correct positioning of a toe and heel of the skate blade within the blade holder tool.

16. A blade holder for removable skate blades, the blade holder comprising:

a first sidewall and a second sidewall forming a blade engagement channel, the first sidewall positioned opposite the second sidewall;

a blade engagement mechanism comprising:

at least a first blade-engaging member positioned on a first side of the blade engagement channel, at least the first blade engaging member configured to move toward the opposite sidewall of the blade holder;

a cam mechanism rotatably coupled to the blade holder, wherein when rotated, the cam mechanism is configured to manipulate the position of at least the first blade-engaging member; and a user-controlled component configured to control rotation of the cam mechanism, wherein manipulation of the user-controlled component from a first position to a second position moves the first blade-engaging member to engage a respective side of the skate blade such that the first blade-engaging member holds the skate blade at a bottom portion of the blade engagement channel and a skating edge of the skate blade extends beyond the bottom surfaces of the first sidewall and second sidewall.

17. The blade holder of claim 16, wherein the cam mechanism further comprises a lobe positioned on at least a portion of the cam, and, when rotated, the lobe is configured to move at least the first blade-engaging member to engage the skate blade.

18. The blade holder of claim 16, wherein the blade engagement mechanism further comprises a second blade-engaging member, the second blade-engaging member positioned on a second side of the blade engagement channel, wherein manipulation of the user-controlled component from the first position to the second position moves the first blade-engaging member toward the second blade-engaging member and the second blade-engaging member is configured to move toward the first blade-engaging member such that the first blade-engaging member and second blade-engaging member engage the skate blade and hold the skate blade at the bottom portion of the blade holder tool.

19. The blade holder of claim 16, wherein the blade engagement channel has at least one vertical positioning feature defining a vertical stop within the blade engagement channel configured to position the skate blade at a defined height when engaged with the vertical positioning feature, wherein the at least one vertical positioning feature is configured to constrain rotation of the skate blade such that the skate blade is positioned in a substantially horizontal position when engaged with the at least one vertical positioning feature.

* * * * *